US009803152B2

(12) United States Patent
Kar et al.

(10) Patent No.: US 9,803,152 B2
(45) Date of Patent: Oct. 31, 2017

(54) MODIFICATION OF FUEL OILS FOR COMPATIBILITY

(71) Applicant: ExxonMobil Research and Engineering Company, Annandale, NJ (US)

(72) Inventors: Kenneth Chi Hang Kar, Philadelphia, PA (US); Sheryl B. Rubin-Pitel, Newtown, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 15/235,538

(22) Filed: Aug. 12, 2016

(65) Prior Publication Data

US 2017/0044451 A1 Feb. 16, 2017

Related U.S. Application Data

(60) Provisional application No. 62/204,716, filed on Aug. 13, 2015.

(51) Int. Cl.

*C10L 1/08* (2006.01)
*C10L 1/14* (2006.01)
*C10L 1/24* (2006.01)

(52) U.S. Cl.

CPC *C10L 1/08* (2013.01); *C10L 1/14* (2013.01); *C10L 1/245* (2013.01); *C10L 1/2437* (2013.01);

(Continued)

(58) Field of Classification Search

CPC ..... C10L 1/08; C10L 1/14; C10L 2270/026; C10L 2200/0438; C10L 2290/24; C10L 2290/60; C10L 1/2437; C10L 1/245

See application file for complete search history.

(56) References Cited

U.S. PATENT DOCUMENTS 4,441,890 A 4/1984 Feldman
5,871,634 A 2/1999 Wiehe et al.

(Continued)

FOREIGN PATENT DOCUMENTS

FR 3011004 A1 3/2015
WO 9113951 A1 9/1991

(Continued)

OTHER PUBLICATIONS

Barsamian, Ara, Bunker Blending, Aug. 2013, Hydrocarbon Engineering, pp. 1-4.*

(Continued)

*Primary Examiner* — Cephia D Toomer

(74) *Attorney, Agent, or Firm* — Jamie L. Sullivan; Anthony G. Boone

(57) ABSTRACT

Methods are provided for determining the compatibility of various grades of fuel oils, as well as methods for modifying fuel oils to improve compatibility and improved compatibility compositions. It has been discovered that the toluene equivalent solvation power of a blend of fuel oils does not vary in a straightforward manner with respect to the toluene equivalent solvation power of the individual blend components. Instead, it has been determined that the asphaltene content of the individual components can also influence the toluene equivalent solvation power of the final blend. Based on this discovery, methods are provided that can allow for modification of one or more components of a potential fuel oil blend. This can reduce and/or minimize the likelihood of asphaltene precipitation when a fuel oil blend is formed.

20 Claims, 6 Drawing Sheets

(52) U.S. Cl.
CPC . *C10L 2200/0438* (2013.01); *C10L 2270/026* (2013.01); *C10L 2290/24* (2013.01); *C10L 2290/60* (2013.01)

(56) References Cited

U.S. PATENT DOCUMENTS

| | | | |
|---|---|---|---|
| 5,997,723 | A | 12/1999 | Wiehe et al. |
| 8,987,537 | B1 | 3/2015 | Droubi et al. |

FOREIGN PATENT DOCUMENTS

| | | | |
|---|---|---|---|
| WO | 2009058262 | A1 | 5/2009 |
| WO | 2014096703 | A1 | 6/2014 |

OTHER PUBLICATIONS

Barsamian, Ara, Blending Art and Science, Winter 2013, World Bunkering, pp. 30-33.*

Smith, Harold M., Correlation Index to Aind in Interpreting Crude-Oil Analyses, 1940, Bureau of Mines Technical Paper 610, pp. 1-42.*

PCT/US2016/046748 International Search Report and Written Opinion dated Oct. 21, 2016.

* cited by examiner

Examples of Regular Sulfur Fuel Oils

| | Fuel Oil A | Fuel Oil B | Fuel Oil C | Fuel Oil D |
|---|---|---|---|---|
| Distillation (Up to 750°C) | | | | |
| T0.5 (°C) | ~171 | ~192 | ~163 | ~139 |
| T10 (°C) | ~333 | ~291 | ~280 | ~248 |
| T30 (°C) | ~445 | ~368 | ~393 | ~392 |
| T50 (°C) | ~513 | ~536 | ~489 | ~583 |
| T70 (°C) | ~590 | ~627 | ~582 | ~649 |
| T90 (°C) | ~700 | ~709 | ~705 | ~729 |
| T99.5 (°C) | 750+ | 750+ | 750+ | 750+ |
| %wt recovered | ~95.4 | ~97.3 | ~93.7 | ~93.1 |
| Density at 15°C | ~0.9900 | ~0.9664 | ~0.9859 | ~0.9082 |
| KV50 (cSt) | ~358.2 | ~106.9 | ~366.1 | ~34.0 |
| CCAI | ~828 | ~852 | ~842 | ~847 |
| BMCI (ABP method) | ~63.4 | ~72.7 | ~65.2 | ~67.5 |
| TE | ~0.0 | ~30.0 | ~19.0 | ~100.0 |
| BMCI-TE | ~63.4 | ~42.7 | ~50.2 | ~~32.5 |
| Asphaltene (%wt) | ~1.0 | ~3.2 | ~5.0 | <0.50 |
| Carbon residue (%wt) | <18 | ~11.7 | <18 | <18 |

FIG. 5

Examples of Low Sulfur Fuel Oils

| | Fuel Oil W | Fuel Oil X | Fuel Oil Y | Fuel Oil Z |
|---|---|---|---|---|
| Distillation (Up to 750°C) | | | | |
| T0.5 (°C) | ~237 | ~140 | ~157 | ~252 |
| T10 (°C) | ~341 | ~234 | ~273 | ~321 |
| T30 (°C) | ~402 | ~339 | ~356 | ~371 |
| T50 (°C) | ~440 | ~400 | ~485 | ~409 |
| T70 (°C) | ~482 | ~468 | ~569 | ~448 |
| T90 (°C) | ~539 | ~607 | ~665 | ~503 |
| T99.5 (°C) | ~619 | ~736 | ~744 | ~586 |
| Density at 15°C | | ~0.8741 | ~0.9273 | ~0.9328 |
| KV50 (cSt) | | ~16.0 | ~78.0 | ~53.3 |
| CCAI | ~801 | ~781 | ~807 | |
| BMCI (ABP method) | ~42 | ~30 | ~47 | ~57 |
| TE | 0.0 | 6.0 | 0.0 | 0.0 |
| BMCI-TE | ~42.0 | ~23.9 | ~47.0 | ~56.8 |
| Asphaltene (%wt) | ~0.0 | <0.50 | ~0.67 | |
| Carbon residue (%wt) | | | 5.9 | <0.10 |

FIG. 6

| | Method | Fuel Oil AA | Fuel Oil W | Fuel Oil BB | Fuel Oil CC | Fuel Oil DD | Fuel Oil EE | Fuel Oil FF |
|---|---|---|---|---|---|---|---|---|
| Density at ~15°C (g/mL) | ISO 12185 | ~0.966 | ~0.908 | ~0.855 | ~0.975 | ~1.01 | ~0.876 | ~0.985 |
| KV at ~50°C (cSt) | ISO 3104 | 107.0 | 34.0 | 4.3 | ~4300 | ~454 | ~4.49 | ~319 |
| Sulfur (wt%) | ISO 8754 | ~2.84 | ~0.072 | ~0.053 | ~0.136 | ~3.44 | ~0.22 | ~0.82 |
| Flash point (°C) | ISO2719 Proc. B. | ~104 | 178.0 | ~91.8 | ~250 | >~60 | ~83.5 | ~129 |
| CCAI | Calculation | ~842 | ~801 | ~795 | ~817 | ~869 | ~821 | ~848 |
| BMCI (ABP method) | Calculation | ~65 | ~42 | ~30 | ~64 | ~84 | ~42 | ~73 |
| TE | AMS 79-004 | ~30 | ~0 | ~0 | <~23 | ~63 | ~0 | <~23 |
| Ash (%wt) | ISO 6245 | ~0.026 | <0.001 | - | ~0.008 | ~0.044 | - | <0.001 |
| Asphaltene (%wt) | ASTM D4870 | ~3.2 | <~0.50 | ~0 | ~1.5 | ~8.1 | ~0 | ~0.65 |
| Carbon residue (%wt) | ISO 10370 | <~18 | - | <0.001 | ~8.86 | ~16.4 | ~0.1 | ~10.3 |
| Total sediment (%wt) | ISO 10307-2 | ~0.02 | ~0.02 | NA | <0.01 | ~0.03 | NA | ~0.02 |
| Pour Point (°C) | ISO 3016 | <30 | ~9 | ~7 | ~24 | <30 | ~-7 | ~9 |
| Total Saturates | 2D-GC | | 44.6% | 63.2% | | | | |
| Paraffins | 2D-GC | | 25.1% | 36.3% | | | | |
| Naphthenics | 2D-GC | | 19.5% | 26.9% | | | | |
| Total Aromatics | 2D-GC | | 55.4% | 36.8% | | | | |
| | | | | | | | *D86 distillation | |
| wt% recovered | M1567 SimDis by GC | ~93.7 | ~101.7 | ~100.2 | ~97.9 | ~92.4 | ~96.1 | ~95.3 |
| T10 (°C) | M1567 SimDis by GC | 280 | 341 | 229 | 433 | 276 | 249 | 285 |
| T50 (°C) | M1567 SimDis by GC | 489 | 440 | 325 | 561 | 512 | 312 | 547 |
| T90 (°C) | M1567 SimDis by GC | 705 | 539 | 401 | 702 | 723 | 373 | 719 |
| 1050F+ (wt%) | M1567 SimDis by GC | ~34 | ~5 | ~0 | ~49 | ~38 | ~0 | ~47 |

FIG. 7

| T (°C) at wt% recovered | Fuel Oil AA | Fuel Oil W | Fuel Oil BB | Fuel Oil CC | Fuel Oil DD | Fuel Oil EE | Fuel Oil FF |
|---|---|---|---|---|---|---|---|
| 0.5 | 163 | 237 | 134 | 323 | 158 | 199 | 187 |
| 1 | 183 | 257 | 152 | 346 | 171 | | 203 |
| 2 | 211 | 279 | 169 | 369 | 191 | | 220 |
| 3 | 224 | 293 | 182 | 384 | 205 | | 235 |
| 4 | 237 | 303 | 192 | 396 | 219 | | 240 |
| 5 | 244 | 311 | 199 | 404 | 229 | | 249 |
| 10 | 280 | 341 | 229 | 433 | 276 | 249 | 285 |
| 15 | 312 | 361 | 250 | 454 | 325 | | 308 |
| 20 | 341 | 377 | 265 | 472 | 365 | | 328 |
| 25 | 368 | 391 | 278 | 488 | 397 | | 346 |
| 30 | 393 | 402 | 289 | 503 | 421 | | 365 |
| 35 | 417 | 412 | 300 | 517 | 444 | | 382 |
| 40 | 440 | 422 | 308 | 532 | 467 | | 408 |
| 45 | 465 | 431 | 317 | 547 | 490 | | 501 |
| 50 | 489 | 440 | 325 | 561 | 512 | 312 | 547 |
| 55 | 513 | 450 | 333 | 575 | 534 | | 573 |
| 60 | 537 | 460 | 343 | 590 | 557 | | 593 |
| 65 | 559 | 471 | 350 | 604 | 578 | | 611 |
| 70 | 582 | 482 | 358 | 619 | 599 | | 629 |
| 75 | 603 | 494 | 367 | 636 | 623 | | 648 |
| 80 | 629 | 507 | 376 | 654 | 651 | | 669 |
| 85 | 660 | 522 | 387 | 676 | 684 | | 694 |
| 90 | 705 | 539 | 401 | 702 | 723 | 373 | 719 |
| 91 | 716 | 543 | 403 | 707 | 732 | | 724 |
| 92 | 727 | 548 | 407 | 713 | 744 | | 729 |
| 93 | 739 | 553 | 411 | 719 | 750 | | 734 |
| 94 | 750 | 558 | 414 | 724 | - | | 740 |
| 95 | - | 563 | 419 | 729 | - | | 747 |
| 96 | - | 570 | 423 | 736 | - | | 750 |
| 97 | - | 578 | 430 | 743 | - | | - |
| 98 | - | 589 | 438 | 750 | - | | - |
| 99 | - | 604 | 451 | - | - | | - |
| 99.5 | - | 619 | 464 | - | - | 389 | - |

FIG. 8

MODIFICATION OF FUEL OILS FOR COMPATIBILITY

CROSS-REFERENCE TO RELATED APPLICATIONS

This application claims the benefit of U.S. Provisional Application No. 62/204,716, filed on Aug. 13, 2015, the entire contents of which are incorporated herein by reference.

FIELD OF THE INVENTION

This invention relates to methods for improving the compatibility of fuel oils.

BACKGROUND OF THE INVENTION

Marine fuel oil, sometimes referred to as bunker fuel, has traditionally provided a use for heavy oil fractions that are otherwise difficult and/or expensive to convert to a beneficial use. Due in part to use of fuels allowed to have relatively high sulfur content in international waters, vacuum resid fractions as well as other lightly processed (or even unprocessed) fractions can be incorporated into traditional fuel oils.

More recently, many countries have adopted local specifications for lower sulfur emissions from marine vessels. This can result in some vessels carrying two types of fuel oil, with one type being suitable for international waters while a second type can be used while satisfying the more stringent local regulations.

U.S. Pat. No. 5,997,723 describes methods for blending petroleum oils to avoid incompatible blends. Petroleum oils can be characterized based on a solubility number ($S_{BN}$) and an insolubility number ($I_N$). The goal during blending can be to select blends that either maintain a desired ratio of solubility number to insolubility number, such as at least 1.3, or to select blends having a minimum difference between solubility number and insolubility number, such as at least 20. The solubility number for a blend of petroleum oils is described as a weighted average of the solubility numbers for the individual components.

U.S. Pat. No. 4,441,890 describes use of alkaryl sulfonic acid additives for reducing or inhibiting the formation of asphaltic sediment in fuel oils.

U.S. Pat. No. 8,987,537 describes low sulfur marine fuel compositions, such as a sulfur content of 0.1 wt % or less. The fuel compositions are formed by combining 50 to 90 wt % of a resid fraction, such as an atmospheric resid, with 10 to 50 wt % of an additional hydrocarbon component that is optionally a hydroprocessed hydrocarbon component.

French Publication No. FR 3011004 describes marine fuel compositions formed by blending a heavy distillate boiling range fraction from a cracking process, optionally after hydrotreatment, with a straight run distillate fraction or hydrotreated distillate fraction.

SUMMARY OF THE INVENTION

In various aspects, the invention can include fuel oil blendstocks/compositions having improved compatibility and methods for improving the compatibility of fuel oils, such as fuel oils having varying contents of sulfur. The methods can include treating one or more fuel oils to modify properties such as asphaltene content, kinematic viscosity, density, and/or other properties. This can allow for reduced or minimized formation of solids (increased compatibility) when fuel oils are mixed, such as in a fuel delivery system for a marine vessel.

BRIEF DESCRIPTION OF THE DRAWINGS

FIG. 5 shows examples of several heavy fuel oils having a sulfur content of less than about 3.5 wt %.

FIG. 6 shows examples of several low sulfur fuel oils having a sulfur content of less than about 0.1 wt %.

FIG. 7 shows select physico-chemical properties of a variety of fuel oils/blendstocks.

FIG. 8 shows greater detail of the boiling range profile of those fuel oils/blendstocks from FIG. 7.

DETAILED DESCRIPTION OF THE EMBODIMENTS

Figure 1:
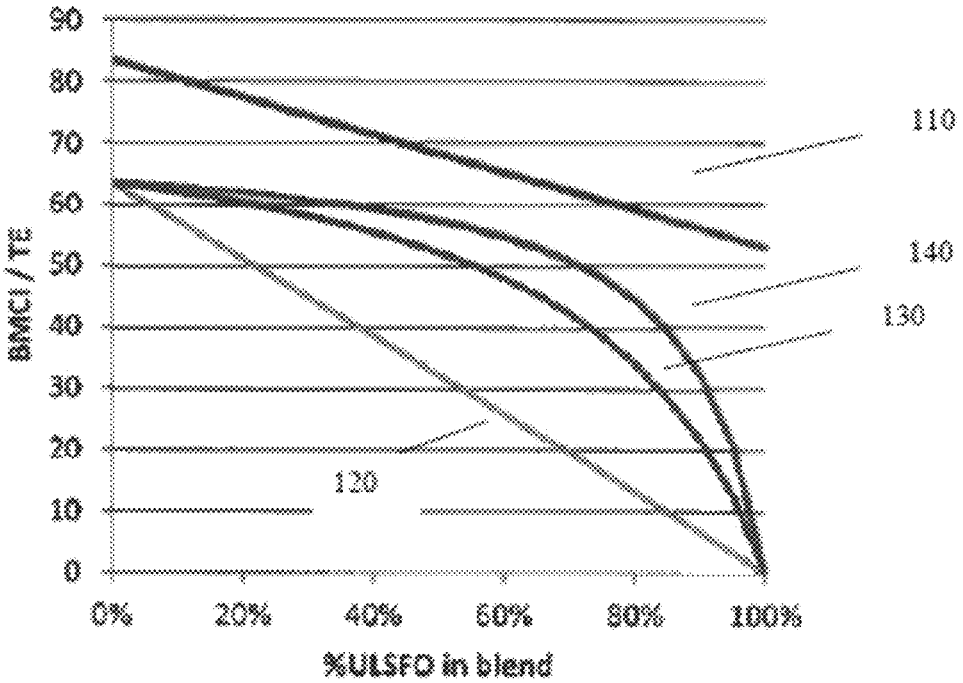
FIG. 1 schematically shows an example of BMCI and TE values for blends of fuel oils having various asphaltene contents.

In various aspects, the invention can include fuel oil blendstocks/compositions having improved compatibility and methods for determining the compatibility of various grades of fuel oils, as well as for modifying fuel oils to improve compatibility. It has been discovered that the toluene equivalent solvation power of a blend of fuel oils does not necessarily vary in a straightforward manner with respect to the toluene equivalent solvation power of the individual blend components. Additionally or alternatively, it has been determined that the asphaltene content of the individual components can influence the toluene equivalent solvation power of the final blend. Based on the recognition of the complexity of one or both of these relationships, methods are provided herein to enable modification of one or more components of a potential fuel oil blend, advantageously to reduce and/or minimize the likelihood of undesirable immiscibility (e.g., asphaltene precipitation) when another component is added to an existing fuel composition to form a fuel oil blend.

When a vessel moves from international waters to local waters, the permitted sulfur emissions from the vessel can be restricted. For example, in January of 2015, Emission Control Areas were instituted corresponding to the coastal waters of various countries. In such Emission Control Areas, marine vessels were constrained to have emissions corresponding to the expected emissions from combustion of a low sulfur fuel oil having a sulfur content of about 0.1 wt % or less. By contrast, in international waters, current regulations still allow for emissions corresponding to a fuel oil containing up to about 3.5 wt % sulfur. One option for handling these different requirements can be to use a scrubber or other emission control technology on the vessel emissions when in Emission Control Areas. This can allow a vessel to use a single type of fuel oil while using emission control technology to satisfy local regulations. However, many vessels do not have the benefit of such emission control technology.

Another option can be to modify the type of fuel oil used, depending on the location of the vessel. In this type of option, a "regular sulfur" fuel oil can be used in international waters, while a "low sulfur" fuel oil can be used when emission control regulations apply. This can allow for the substantially less expensive regular sulfur fuel oil to be used for the bulk of a voyage by a vessel. However, if the regular sulfur fuel oil and the low sulfur fuel oil are not compatible (e.g., sufficiently miscible), the transition between one type of fuel oil to another can lead to precipitation (e.g., of asphaltenes) within the fuel delivery system. For example, many marine vessels may have only one fuel delivery system for the engines of the vessel. During a transition from a regular sulfur fuel oil to a low sulfur fuel oil (or vice versa), the two different types of fuel oil can be blended together, such as in the service tank (day tank), with a wide variety of potential blends being created. If a blend is formed locally within the fuel delivery system that corresponds to an incompatible blend ratio for the fuel oils, asphaltenes and/or other solids may precipitate out (form solids) within the fuel delivery system. These precipitates can quickly lead to clogging of filters within the fuel delivery system, among other issues.

In various aspects, precipitation of asphaltenes and/or other solids due to mixing of incompatible fuel oils can be reduced and/or minimized by modifying at least one fuel oil to improve compatibility. This can correspond to increasing the solubility number and/or Bureau of Mines Compatibility Index (BMCI) of a fuel oil, decreasing the insolubility number and/or Toluene Equivalence (TE) value of a fuel oil, or a combination thereof. The amount of modification can be based at least in part on the unexpected relationship between the toluene equivalence of a blend of fuel oils and the asphaltene content of the individual fuel oil components in the blend.

Characterizing Solubility and Potential for Asphaltene Precipitation

In order to characterize potential fuel oils with regard to compatibility, one or more methods can be selected to describe the characteristics of a fuel oil with regard to the tendency to form precipitates and/or deposit coke on surfaces. In some aspects, such methods can be directed to the ability of a fuel oil to maintain solubility of asphaltenes and/or the amount of solvency power required to avoid phase separation of asphaltenes.

In this discussion, asphaltenes are defined as corresponding to n-heptane insoluble compounds as can be characterized using ASTM D6560. Such n-heptane insoluble asphaltenes can typically be understood as compounds insoluble in n-heptane while being soluble in toluene, under the conditions set forth in ASTM D6560. According to the ASTM standard, if less than 0.5 mass % of a sample yields insoluble solids in n-heptane at the appropriate conditions, the test outcome is noted to be completely n-heptane soluble. It is noted, however, that asphaltenes or asphaltene-type compounds can also be at least partially identified by their solubility/insolubility in one or more other solvents. Such alternative solvents can include, but are not limited to, other $C_3$-$C_7$ alkanes, toluene, or combinations thereof.

Although the asphaltene content of a fuel oil sample can be characterized directly, such as by using ASTM D6560, other methods of characterization can also be used. For example, another method for characterizing a fuel oil sample can be based on a Micro Carbon Residue (MCR) test. In an exemplary MCR test, about 4 grams of a sample can be put into a weighed glass bulb. The sample in the bulb can then be heated in a bath at ~553° C. for about 20 minutes. After cooling, the bulb can be weighed again and the difference noted. While the MCR test does not provide a direct measure of the asphaltene content, the MCR value is generally believed to be highly correlated with the tendency of a petroleum fraction to form coke, and therefore may provide an alternate/approximate indication of the asphaltene content.

The Bureau of Mines Correlation Index (BMCI) can provide another method for characterizing the properties of a fuel oil (or another petroleum fraction). The BMCI index can provide an indicator of the ability of a fuel oil fraction to maintain solubility of compounds such as asphaltenes. The BMCI index can be calculated based on Equation (1):

$$BMCI = \frac{48640}{VABP} + (473.7 \times d_{60}) - 456.8 \quad (1)$$

In Equation (1), VABP refers to the volume average boiling point (in degrees Kelvin) of the fraction, which can be determined based on the fractional weight boiling points for distillation of the fraction at roughly 10 vol % intervals from ~10 vol % to ~90 vol %. The "$d_{60}$" value refers to the density in g/cm$^3$ of the fraction at ~60° F. (~16° C.). While this definition does not directly depend on the nature of the compounds in the fraction, the BMCI index value is believed to provide an indication of the ability of a fuel oil fraction to solvate asphaltenes.

An additional/alternative method of characterizing the solubility properties of a fuel oil (or other petroleum fraction) can correspond to the toluene equivalence (TE) of a fuel oil, based on the toluene equivalence test as described, for example, in U.S. Pat. No. 5,871,634, which is incorporated herein by reference with regard to the definitions for and descriptions of toluene equivalence, solubility number ($S_{BN}$), and insolubility number ($I_N$).

For the toluene equivalence test, the procedure specified in AMS 79-004 and/or as otherwise published (e.g., see Griffith, M. G. and Siegmund, C. W., "Controlling Compatibility of Residual Fuel Oils," *Marine Fuels, ASTM STP* 878, C. H. Jones, Ed., American Society for Testing and Materials, Philadelphia, 1985, pp. 227-247, which is hereby incorporated by reference herein) is defined as providing the procedure. Generally, a convenient volume ratio of oil to a test liquid mixture can be selected, such as about 2 grams of fuel oil (with a density of about 1 g/ml) to about 10 ml of test liquid mixture. Then various mixtures of the test liquid mixture can be prepared by blending n-heptane and toluene in various known proportions. Each of these can be mixed with the fuel oil at the selected volume ratio of oil to test liquid mixture. A determination can then be made for each oil/test liquid mixture to determine if the asphaltenes are soluble or insoluble. Any convenient method might be used. One possibility can be to observe a drop of the blend of test liquid mixture and oil between a glass slide and a glass cover slip using transmitted light with an optical microscope at a magnification from ~50× to ~600×. If the asphaltenes are in solution, few, if any, dark particles will be observed. If the asphaltenes are insoluble, many dark, usually brownish, particles, usually ~0.5 microns to ~10 microns in size, can be observed. Another possible method can be to put a drop of the blend of test liquid mixture and oil on a piece of filter paper and let it dry. If the asphaltenes are insoluble, a dark ring or circle will be seen about the center of the yellow-brown spot made by the oil. If the asphaltenes are soluble, the color of the spot made by the oil will be relatively uniform in color. The results of blending oil with all of the test liquid mixtures can then be ordered according to increasing percent toluene in the test liquid mixture. The desired TE value can be between the minimum percent toluene that dissolves asphaltenes and the maximum percent toluene that precipitates asphaltenes. Depending on the desired level of accuracy, more test liquid mixtures can be prepared with percent toluene amounts in between these limits. The additional test liquid mixtures can be blended with oil at the selected oil to test liquid mixture volume ratio, and determinations can be made whether the asphaltenes are soluble or insoluble. The process can be continued until the desired value is determined within the desired accuracy. The final desired TE value can be taken as the mean of the minimum percent toluene that dissolves asphaltenes and the maximum percent toluene that precipitates asphaltenes.

The above test method for the toluene equivalence test can be expanded to allow for determination of a solubility number ($S_{BN}$) and an insolubility number ($I_N$) for a fuel oil sample. If it is desired to determine $S_{BN}$ and/or $I_N$ for a fuel oil sample, the toluene equivalence test described above can be performed to generate a first data point corresponding to a first volume ratio $R_1$ of fuel oil to test liquid at a first percent of toluene $T_1$ in the test liquid at the TE value. After generating the TE value, one option can be to determine a second data point by a similar process but using a different oil to test liquid mixture volume ratio. Alternatively, a percent toluene below that determined for the first data point can be selected and that test liquid mixture can be added to a known volume of the fuel oil until asphaltenes just begin to precipitate. At that point the volume ratio of oil to test liquid mixture, $R_2$, at the selected percent toluene in the test liquid mixture, $T_2$, can be used the second data point. Since the accuracy of the final numbers can increase at greater distances between the data points, one option for the second test liquid mixture can be to use a test liquid containing 0% toluene or 100% n-heptane. This type of test for generating the second data point can be referred to as the heptane dilution test.

Based on the toluene equivalence test and heptane dilution test (or other test so that $R_1$, $R_2$, $T_1$, and $T_2$ are all defined), the insolubility and solubility numbers for a sample can be calculated based on Equations (2) and (3).

$$I_N = T_2 - \left[\frac{T_2 - T_1}{R_2 - R_1}\right]R_2 \tag{2}$$

$$S_{BN} = I_N[1 + 1/R_2] - T_2/R_2 \tag{3}$$

As noted in U.S. Pat. No. 5,871,634, alternative methods are available for determining the solubility number of a fuel oil that has an insolubility number of zero.

Compatibility of Fuel Oil Fractions

Based on the above methods for characterizing the properties of a fuel oil, several conventional methods can be used for determining whether a blend of fuel oils is compatible. Such conventional determinations have been based on the differences between the $S_{BN}$ and $I_N$, or the difference between the BMCI index and the TE. For example, a conventional definition of compatibility can be based on having a difference between the $S_{BN}$ and $I_N$ for a fuel oil blend of at least about 20. Another conventional definition can be based on having a difference between the BMCI index and the TE value of at least about 7, or at least about 10, or at least about 14, or at least about 15.

In conventional determinations of compatibility for blends of fuel oils, it has been assumed that the value of a property for a blend of fuel oils can correspond to a weighted average of the corresponding property for the individual fuel oil components. However, it has now been determined that the TE value for a blend of fuel oils can have a substantially different behavior. Instead of behaving as a weighted average, it has been determined that the TE value for a blend of fuel oils can be expressed by Equation (4).

$$TE = \Sigma TE_i * A_i * y_i / \Sigma A_i * y_i \tag{4}$$

In Equation (4), "i" denotes the $i^{th}$ component in a blend; $TE_i$ is the toluene equivalence value of component i; $A_i$ is the asphaltene content of component i; and $y_i$ is the mass fraction of component i. As shown in Equation (4), instead of behaving as an average based on mass fraction, it is believed that the TE value for a blend is weighted based on both the insoluble (asphaltene) content and the mass fraction of a component. Due to the additional dependence on the insoluble (asphaltene) content, Equation (4) shows that, in situations where the asphaltene content differs by a large amount between fuel oil components, the toluene equivalence value of a blend of fuel oils can be substantially larger than would be expected, based solely on the ratios of the components. However, since the BMCI index value does not have a similar dependence, it can be seen that fuel oils with differing insoluble (asphaltene) contents can have localized blend ratios of incompatibility, even though the individual blend components may appear compatible based on linear estimation of values. It is noted that the definitions of $S_{BN}$ and $I_N$ can also be indirectly based in part on the TE value, and therefore use of $S_{BN}$ and $I_N$ for compatibility determination can potentially be impacted by this discovery of the dependence of TE values for blends of fuel oils on the insoluble (asphaltene) content of the components.

Properties of Fuel Oils

Conventionally, fuel oils can often be referred to by the sulfur content of the fuel oil. A regular sulfur fuel oil can correspond to a fuel oil having a sulfur content of about 0.15 wt % to about 3.5 wt %, for example about 0.3 wt % to about 3.5 wt %, about 0.5 wt % to about 3.5 wt %, about 1.0 wt % to about 3.5 wt %, about 1.5 wt % to about 3.5 wt %, about 2.0 wt % to about 3.5 wt %, about 0.1 wt % to about 3.0 wt %, about 0.3 wt % to about 3.0 wt %, about 0.5 wt % to about 3.0 wt %, about 1.0 wt % to about 3.0 wt %, about 1.5 wt % to about 3.0 wt %, about 2.0 wt % to about 3.0 wt %, about 0.1 wt % to about 2.5 wt %, about 0.3 wt % to about 2.5 wt %, about 0.5 wt % to about 2.5 wt %, about 1.0 wt % to about 2.5 wt %, or about 1.5 wt % to about 2.5 wt %. A low sulfur fuel oil can have a sulfur content of about 0.01 wt % (~100 wppm) to about 0.1 wt % (~1000 wppm), for example about 0.01 wt % to about 0.05 wt %, about 0.02 wt % to about 0.1 wt %, about 0.02 wt % to about 0.05 wt %, or about 0.05 wt % to about 0.1 wt %. A medium sulfur fuel oil can have a sulfur content of about 0.05 wt % (~500 wppm) to about 0.5 wt % (~5000 wppm), for example about 0.1 wt % to about 0.5 wt %, about 0.05 wt % to about 0.3 wt %, or about 0.1 wt % to about 0.3 wt %. A very low (or ultra-low) sulfur fuel oil can have a sulfur content of about 0.0001 wt % (~1 wppm) to about 0.05 wt % (~500 wppm), for example about 0.0001 wt % to about 0.03 wt %, about 0.001 wt % to about 0.05 wt %, about 0.001 wt % to about 0.03 wt %, about 0.005 wt % to about 0.05 wt %, about 0.005 wt % to about 0.03 wt %, about 0.01 wt % to about 0.05 wt %, or about 0.01 wt % to about 0.03 wt %.

Based on the unexpected relationship between asphaltene content of components in a fuel oil blend and the resulting TE value for a blend, various desirable properties for the components in a fuel oil blend can be determined, such as desirable properties for reducing or minimizing asphaltene precipitation and/or coke formation, when an engine fuel delivery system is transitioned from using a regular sulfur fuel oil to using a low sulfur fuel oil, and/or when an engine fuel delivery system is transitioned from using a low sulfur fuel oil to a regular sulfur fuel oil. Unlike marine distillate fuels, fuel oils can require a heated fuel system for proper operation. Fuel oils can tend to have a high viscosity, and the heated fuel system can assist with allowing a fuel oil to have desirable flow properties within the fuel system. Many marine vessels can have only one heated fuel system. As a result, when a marine vessel enters an emission control area, the marine vessel can switch from regular sulfur fuel oil to low (or very low) sulfur fuel oil. Similarly, the marine vessel can return to use of regular sulfur fuel oil after exiting an emission control area. During such a switch, regular sulfur fuel oil and low sulfur fuel oil can mix, with the mixing ration being unpredictable at any given location within the vessel's fuel system. If there are any blend ratios where the regular sulfur fuel oil and low (or very low) sulfur fuel oil are incompatible, it can be likely for the unpredictable mixing of fuel oil in the heated fuel system to result in asphaltene precipitation.

One option for maintaining compatibility between a regular sulfur fuel oil and a low (or very low) sulfur fuel oil across all or substantially all possible blend ratios can be to select a low (or very low) sulfur fuel oil and/or modify a low (or very low) sulfur fuel oil to have a desired set of properties, so that the low (or very low) sulfur fuel oil can advantageously be compatible (at substantially all blend ratios) with a wide(r) range of regular sulfur fuel oils, such as substantially all conventional regular sulfur fuel oils. As shown in Equation 4, one factor in selecting a low (or very low) sulfur fuel oil and/or modifying a low (or very low) sulfur fuel oil for compatibility can be the asphaltene content. A low sulfur fuel oil containing at least a minimum level of asphaltene content can be more likely to have an ability to maintain asphaltenes from a regular sulfur fuel oil in solution. By combining a low/minimum asphaltene content with other general specifications for the properties of a low sulfur fuel oil, a set of properties can be provided to allow a low sulfur fuel oil to be (more) generally compatible with regular sulfur fuel oils.

In some aspects, a regular sulfur fuel oil can have one or more properties that can result in increased difficulty in selecting and/or modifying a low (or very low) sulfur fuel oil for compatibility. For example, a difference between the BMCI value and the toluene equivalence (TE) value of a regular sulfur fuel oil (or alternatively a medium sulfur fuel oil) can be about 50 or less, for example about 45 or less, about 40 or less, about 35 or less, or about 30 or less. It is understood that a difference between a BMCI value and TE value for a fuel oil can typically be at least about 7, for example at least about 10, at least about 14, or at least about 15, as otherwise precipitation of asphaltenes would be likely even without combining such a fuel oil with another composition. A relatively small difference between the BMCI value and the TE value for a regular sulfur fuel oil can be an indicator that a regular sulfur fuel oil (or medium sulfur fuel oil) has a higher likelihood of being incompatible with a low (or very low) sulfur fuel oil.

Another relationship between the properties of a regular sulfur fuel oil (or a medium sulfur fuel oil) and a low sulfur fuel oil (or very low sulfur fuel oil) can be a relationship between the TE value of the regular sulfur fuel oil and the BMCI value of the low sulfur fuel oil. For example, selecting a low sulfur fuel oil with a BMCI value sufficiently greater than the TE value of a regular sulfur fuel oil can avoid problems with compatibility. For situations where the BMCI value of a low sulfur fuel oil is not sufficiently greater than the TE value of the regular sulfur fuel oil, modification of the low sulfur fuel oil may improve the compatibility. For example, if the TE value of the regular sulfur fuel oil is at least about 0.70 times the BMCI value of the low sulfur fuel oil, for example at least about 0.75 times, at least about 0.80 times, at least about 0.85 times, at least about 0.90 times, at least about 0.95 times, or at least equal to the BMCI value of the low sulfur fuel oil, it can be valuable to modify the low sulfur fuel oil for compatibility.

Still another relationship between the properties of a regular sulfur fuel oil (or medium sulfur fuel oil) and a low sulfur fuel oil (or very low sulfur fuel oil) can be a difference between the asphaltene contents. In various aspects, the asphaltene content of the regular sulfur fuel oil (or medium sulfur fuel oil) can be at least about 2.0 wt % greater than the asphaltene content of the low sulfur fuel oil (or very low sulfur fuel oil), for example at least about 2.5 wt %, at least about 3.0 wt %, at least about 3.5 wt %, at least about 4.0 wt %, at least about 4.5 wt %, at least about 5.0 wt %, at least about 5.5 wt %, or at least about 6.0 wt %, or at least about 6.5 wt %, such as optionally up to about 15 wt % or less. It is noted that a regular sulfur fuel oil having an asphaltene content greater than a low sulfur fuel oil asphaltene content by at least X % can equivalently be expressed as a low sulfur fuel oil (or very low sulfur fuel oil) having an asphaltene content that is lower than an asphaltene content of a regular sulfur fuel oil (or medium sulfur fuel oil) by at least X %.

With regard to asphaltene content, a low sulfur fuel oil can be selected and/or modified to have an asphaltene content of at least about 2.0 wt %, for example at least about 2.2 wt %, at least about 2.5 wt %, at least about 2.7 wt %, at least about 3.0 wt %, or at least about 3.2 wt %, such as optionally up to about 6.0 wt % or up to about 8.0 wt % (or more). In particular, a low sulfur fuel oil can be selected and/or modified to have an asphaltene content of at least about 2.0 wt %, from about 2.0 to about 8.0 wt %, or from about 2.0 wt % to about 6.0 wt %. It is noted that typical low sulfur fuel oils can typically have asphaltene contents of about 1.5 wt % or less, e.g., about 1.0 wt % or less.

In aspects where a low sulfur fuel oil is modified to increase an asphaltene content, the asphaltene content can be increased by, for example, blending the low sulfur fuel oil with and/or adding a composition that includes at least about 50 wt % of an asphaltene-containing fraction, for example at least about 60 wt % or at least about 70 wt %. Optionally, the asphaltene-containing fraction can have an asphaltene content of at least about 2.5 wt %, for example at least about 3.5 wt % or at least about 4.5 wt %. Additionally or alternatively, the modified low sulfur fuel oil can optionally have an increased asphaltene content that is at least about 0.5 wt % greater than the asphaltene content prior to modification, for example at least about 1.0 wt %, at least about 1.5 wt %, or at least about 2.0 wt %.

In addition to or as an alternative to characterizing the asphaltene content, another option can be to characterize the micro carbon residue (MCR) content of a fuel oil, such as determining MCR according to ISO 10370. A low sulfur fuel oil can be selected to have and/or modified to have an MCR content of at least about 2.7 wt %, for example at least about 3.0 wt %, at least about 3.5 wt %, at least about 4.0 wt %, at least about 4.5 wt %, at least about 5.0 wt %, or at least about 5.5 wt %, such as optionally up to about 10.0 wt % (or more). In particular, a low sulfur fuel oil can be selected to have and/or modified to have an MCR content of at least about 2.7 wt %, from about 3.0 wt % to about 10.0 wt %, or from about 2.7 wt % to about 5.0 wt %. It is noted that typical low sulfur fuel oils can typically have asphaltene contents of about 2.5 wt % or less, for example about 2.0 wt % or less. It is also noted that, for typical fractions, the asphaltene content can be related to the MCR content, with the asphaltene content being about 0.6 times or less of the MCR content.

Another property that can be used for selection and/or modification of a low sulfur fuel oil is density. In various aspects, a low sulfur fuel oil can be selected and/or modified to have a density of about 0.86 g/cm$^3$ to about 0.95 g/cm$^3$ at ~15° C. For example, the density of a low sulfur fuel oil at ~15° C. (either as selected and/or as modified) can be about 0.86 g/cm$^3$ to about 0.95 g/cm$^2$, for example about 0.86 g/cm$^3$ to about 0.94 g/cm$^3$, about 0.86 g/cm$^3$ to about 0.93 g/cm$^3$, about 0.86 g/cm$^3$ to about 0.92 g/cm$^2$, about 0.86 g/cm$^3$ to about 0.91 g/cm$^3$, about 0.86 g/cm$^3$ to about 0.90 g/cm$^3$, about 0.86 g/cm$^3$ to about 0.89 g/cm$^3$, about 0.87 g/cm$^3$ to about 0.95 g/cm$^2$, about 0.87 g/cm$^3$ to about 0.94 g/cm$^3$, about 0.87 g/cm$^3$ to about 0.93 g/cm$^3$, about 0.87 g/cm$^3$ to about 0.92 g/cm$^2$, about 0.87 g/cm$^3$ to about 0.91 g/cm$^3$, about 0.87 g/cm$^3$ to about 0.90 g/cm$^3$, about 0.87 g/cm$^3$ to about 0.89 g/cm$^3$, about 0.88 g/cm$^3$ to about 0.95 g/cm$^2$, about 0.88 g/cm$^3$ to about 0.94 g/cm$^3$, about 0.88 g/cm$^3$ to about 0.93 g/cm$^3$, about 0.88 g/cm$^3$ to about 0.92 g/cm$^2$, about 0.88 g/cm$^3$ to about 0.91 g/cm$^3$, about 0.88 g/cm$^3$ to about 0.90 g/cm$^3$, about 0.89 g/cm$^3$ to about 0.95 g/cm$^2$, about 0.89 g/cm$^3$ to about 0.94 g/cm$^3$, about 0.89 g/cm$^3$ to about 0.93 g/cm$^3$, about 0.89 g/cm$^3$ to about 0.92 g/cm$^2$, about 0.89 g/cm$^3$ to about 0.91 g/cm$^3$, about 0.90 g/cm$^3$ to about 0.95 g/cm$^3$, about 0.90 g/cm$^3$ to about 0.94 g/cm$^3$, about 0.90 g/cm$^3$ to about 0.93 g/cm$^3$, or about 0.90 g/cm$^3$ to about 0.92 g/cm$^3$. In particular, the density of a low sulfur fuel oil at ~15° C. (either as selected and/or as modified) can be about 0.86 g/cm$^3$ to about 0.95 g/cm$^2$, about 0.88 g/cm$^3$ to about 0.95 g/cm$^2$, about 0.86 g/cm$^3$ to about 0.90 g/cm$^3$, or about 0.90 g/cm$^3$ to about 0.95 g/cm$^3$. Without being bound by any particular theory, it is believed that selection of low (or very low) sulfur fuel oils with a density in the above ranges and/or modification of a low (or very low) sulfur fuel to have a density in the above ranges can, in combination with other properties, provide a suitable ability to solvate asphaltenes to provide compatibility with regular (or medium) sulfur fuel oils. Additionally or alternately, it is believed that using density as a property can provide a more convenient method for characterizing a fuel oil fraction, as compared with performing distillation point measurements that can be needed to determine the average boiling point for determination of BMCI index.

Still another property that can be used for selection and/or modification of a low sulfur fuel oil is kinematic viscosity. In this discussion, kinematic viscosity for a fuel oil at ~50° C. is used, but it is understood that any other convenient kinematic viscosity measurement could also be used to characterize a fuel oil sample. In various aspects, a low sulfur fuel oil can be selected to have and/or modified to have a kinematic viscosity at ~50° C. of about 15 cSt to about 200 cSt. For example, the kinematic viscosity at ~50° C. of a low sulfur fuel oil (either as selected and/or as modified) can be about 15 cSt to about 200 cSt, for example about 15 cSt to about 180 cSt, about 15 cSt to about 160 cSt, about 15 cSt to about 150 cSt, about 15 cSt to about 140 cSt, about 15 cSt to about 130 cSt, about 15 cSt to about 120 cSt, about 15 cSt to about 110 cSt, about 15 cSt to about 100 cSt, about 15 cSt to about 90 cSt, about 15 cSt to about 80 cSt, about 15 cSt to about 70 cSt, about 15 cSt to about 60 cSt, about 15 cSt to about 50 cSt, about 20 cSt to about 200 cSt, about 20 cSt to about 180 cSt, about 20 cSt to about 160 cSt, about 20 cSt to about 150 cSt, about 20 cSt to about 140 cSt, about 20 cSt to about 130 cSt, about 20 cSt to about 120 cSt, about 20 cSt to about 110 cSt, about 20 cSt to about 100 cSt, about 20 cSt to about 90 cSt, about 20 cSt to about 80 cSt, about 20 cSt to about 70 cSt, about 20 cSt to about 60 cSt, about 20 cSt to about 50 cSt, about 25 cSt to about 200 cSt, about 25 cSt to about 180 cSt, about 25 cSt to about 160 cSt, about 25 cSt to about 150 cSt, about 25 cSt to about 140 cSt, about 25 cSt to about 130 cSt, about 25 cSt to about 120 cSt, about 25 cSt to about 110 cSt, about 25 cSt to about 100 cSt, about 25 cSt to about 90 cSt, about 25 cSt to about 80 cSt, about 25 cSt to about 70 cSt, about 25 cSt to about 60 cSt, about 25 cSt to about 50 cSt, about 35 cSt to about 200 cSt, about 35 cSt to about 180 cSt, about 35 cSt to about 160 cSt, about 35 cSt to about 150 cSt, about 35 cSt to about 140 cSt, about 35 cSt to about 130 cSt, about 35 cSt to about 120 cSt, about 35 cSt to about 110 cSt, about 35 cSt to about 100 cSt, about 35 cSt to about 90 cSt, about 35 cSt to about 80 cSt, about 35 cSt to about 70 cSt, about 35 cSt to about 60 cSt, about 45 cSt to about 200 cSt, about 45 cSt to about 180 cSt, about 45 cSt to about 160 cSt, about 45 cSt to about 150 cSt, about 45 cSt to about 140 cSt, about 45 cSt to about 130 cSt, about 45 cSt to about 120 cSt, about 45 cSt to about 110 cSt, about 45 cSt to about 100 cSt, about 45 cSt to about 90 cSt, about 45 cSt to about 80 cSt, about 45 cSt to about 70 cSt, about 55 cSt to about 200 cSt, about 55 cSt to about 180 cSt, about 55 cSt to about 160 cSt, about 55 cSt to about 150 cSt, about 55 cSt to about 140 cSt, about 55 cSt to about 130 cSt, about 55 cSt to about 120 cSt, about 55 cSt to about 110 cSt, about 55 cSt to about 100 cSt, about 55 cSt to about 90 cSt, about 55 cSt to about 80 cSt, about 65 cSt to about 200 cSt, about 65 cSt to about 180 cSt, about 65 cSt to about 160 cSt, about 65 cSt to about 150 cSt, about 65 cSt to about 140 cSt, about 65 cSt to about 130 cSt, about 65 cSt to about 120 cSt, about 65 cSt to about 110 cSt, about 65 cSt to about 100 cSt, about 65 cSt to about 90 cSt, about 75 cSt to about 200 cSt, about 75 cSt to about 180 cSt, about 75 cSt to about 160 cSt, about 75 cSt to about 150 cSt, about 75 cSt to about 140 cSt, about 75 cSt to about 130 cSt, about 75 cSt to about 120 cSt, about 75 cSt to about 110 cSt, about 75 cSt to about 100 cSt, about 85 cSt to about 200 cSt, about 85 cSt to about 180 cSt, about 85 cSt to about 160 cSt, about 85 cSt to about 150 cSt, about 85 cSt to about 140 cSt, about 85 cSt to about 130 cSt, about 85 cSt to about 120 cSt, about 85 cSt to about 110 cSt, about 95 cSt to about 200 cSt, about 95 cSt to about 180 cSt, about 95 cSt to about 160 cSt, about 95 cSt to about 150 cSt, about 95 cSt to about 140 cSt, about 95 cSt to about 130 cSt, about 95 cSt to about 120 cSt, about 105 cSt to about 200 cSt, about 105 cSt to about 180 cSt, about 105 cSt to about 160 cSt, about 105 cSt to about 150 cSt, about 105 cSt to about 140 cSt, about 105 cSt to about 130 cSt, about 115 cSt to about 200 cSt, about 115 cSt to about 180 cSt, about 115 cSt to about 160 cSt, about 115 cSt to about 150 cSt, about 115 cSt to about 140 cSt, about 125 cSt to about 200 cSt, about 125 cSt to about 180 cSt, about 125 cSt to about 160 cSt, or about 125 cSt to about 150 cSt. In particular, the kinematic viscosity at ~50° C. of a low sulfur fuel oil (either as selected and/or as modified) can be about 15 cSt to about 200 cSt, about 25 cSt to about 160 cSt, about 15 cSt to about 70 cSt, or about 75 cSt to about 180 cSt. Without being bound by any particular theory, it is believed that selection of low (or very low) sulfur fuel oils with a kinematic viscosity at ~50° C. in the above ranges and/or modification of a low (or very low) sulfur fuel to have a kinematic viscosity at ~50° C. in the above ranges can, in combination with other properties, provide a suitable ability to solvate asphaltenes to provide compatibility with regular (or medium) sulfur fuel oils. Additionally or alternately, it is believed that using kinematic viscosity at ~50° C. as a property can provide a more convenient method for characterizing a fuel oil fraction, as compared with performing distillation point measurements that can be needed to determine the average boiling point for determination of BMCI index.

Yet another property that can be selected and/or modified for a low sulfur fuel oil is BMCI index. In various aspects, the BMCI index for a low (or very low) sulfur fuel oil can be about 40 to about 120, for example about 50 to about 120, about 60 to about 120, about 70 to about 120, about 80 to about 120, about 90 to about 120, about 40 to about 110, about 50 to about 110, about 60 to about 110, about 70 to about 110, about 80 to about 110, about 40 to about 100, about 50 to about 100, about 60 to about 100, about 70 to about 100, about 40 to about 90, about 50 to about 90, about 60 to about 90, about 40 to about 80, or about 50 to about 80. In particular, the BMCI index for a low (or very low) sulfur fuel oil can be about 40 to about 120, about 40 to about 80, or about 50 to about 100.

In other aspects, an option for maintaining compatibility between a regular (or medium) sulfur fuel oil and a low (or very low) sulfur fuel oil across all or substantially all possible blend ratios can be to select a regular (or medium) sulfur fuel oil and/or modify a regular (or medium) sulfur fuel oil to have a desired set of properties so that the regular (or medium) sulfur fuel oil is compatible (at substantially all blend ratios) with a wide range of low (or very low) sulfur fuel oils, such as substantially all conventional low (or very low) sulfur fuel oils. As shown in Equation (4), one factor in selecting a regular sulfur fuel oil and/or modifying a regular sulfur fuel oil for compatibility can be the asphaltene content. A regular (or medium) sulfur fuel oil containing less than a maximum level of asphaltene content can be more likely to have an ability to maintain asphaltenes in solution when combined with a low (or very low) sulfur fuel oil. By combining a relatively high (near-maximum) asphaltene content with other general specifications for the properties of a regular (or medium) sulfur fuel oil, a set of properties can be provided that will allow a regular (or medium) sulfur fuel oil to be generally compatible with low (or very low) sulfur fuel oils.

With regard to asphaltene content, a regular (or medium) sulfur fuel oil can be selected and/or modified to have an asphaltene content of about 8.5 wt % or less, for example about 8.0 wt % or less, about 7.5 wt % or less, about 7.0 wt % or less, about 6.5 wt % or less, about 6.0 wt % or less, or about 5.5 wt % or less, such as down to about 3.0 wt % (or less). It is noted that regular sulfur fuel oils can typically have asphaltene contents of at least about 4.0 wt %, for example at least about 5.0 wt % or at least about 6.0 wt %. In particular, a regular (or medium) sulfur fuel oil can be selected and/or modified to have an asphaltene content of about 3.0 wt % to about 8.5 wt %, about 4.0 wt % to about 8.0 wt %, or about 4.0 wt % to about 7.5 wt %.

In addition to or as an alternative to characterizing the asphaltene content, another option can be to characterize the micro carbon residue (MCR) content of a fuel oil, such as determining MCR according to ISO 10370. A regular (or medium) sulfur fuel oil can be selected and/or modified to have an MCR content of about 18 wt % or less, for example about 17 wt % or less, about 16 wt % or less, about 15 wt % or less, about 14 wt % or less, about 13 wt % or less, about 12 wt % or less, about 11 wt % or less, about 10 wt % or less, or about 9.0 wt % or less, such as down to about 5.0 wt % (or less). It is noted that typical regular sulfur fuel oils can typically have asphaltene contents of at least about 6.0 wt %, for example at least about 7.5 wt %, at least 9.0 wt %, or at least 10 wt %. In particular, a regular (or medium) sulfur fuel oil can be selected and/or modified to have an MCR content of about 5.0 wt % to about 18 wt %, about 6.0 wt % to about 15 wt %, or about 6.0 wt % to about 12 wt %.

Another property that can additionally or alternatively be used for selection and/or modification of a regular (or medium) sulfur fuel oil is density. In various aspects, a regular (or medium) sulfur fuel oil can be selected and/or modified to have a density at ~15° C. of about 0.95 g/cm$^3$ to about 1.05 g/cm$^3$. For example, the density of a regular (or medium) sulfur fuel oil (either as selected and/or as modified) can be about 0.95 g/cm$^3$ to about 1.05 g/cm$^2$, about 0.95 g/cm$^3$ to about 1.02 g/cm$^2$, about 0.95 g/cm$^3$ to about 1.00 g/cm$^2$, about 0.95 g/cm$^3$ to about 0.99 g/cm$^3$, about 0.95 g/cm$^3$ to about 0.98 g/cm$^3$, about 0.95 g/cm$^3$ to about 0.97 g/cm$^3$, about 0.96 g/cm$^3$ to about 1.05 g/cm$^2$, about 0.96 g/cm$^3$ to about 1.02 g/cm$^2$, about 0.96 g/cm$^3$ to about 1.00 g/cm$^2$, about 0.96 g/cm$^3$ to about 0.99 g/cm$^3$, about 0.96 g/cm$^3$ to about 0.98 g/cm$^3$, about 0.97 g/cm$^3$ to about 1.05 g/cm$^2$, about 0.97 g/cm$^3$ to about 1.02 g/cm$^3$, about 0.97 g/cm$^3$ to about 1.00 g/cm$^3$, about 0.97 g/cm$^3$ to about 0.99 g/cm$^2$, about 0.98 g/cm$^3$ to about 1.05 g/cm$^2$, about 0.98 g/cm$^3$ to about 1.02 g/cm$^3$, or about 0.98 g/cm$^3$ to about 1.00 g/cm$^3$. In particular, the density of a regular (or medium) sulfur fuel oil (either as selected and/or as modified) can be about 0.95 g/cm$^3$ to about 1.05 g/cm$^2$, about 0.95 g/cm$^3$ to about 0.99 g/cm$^3$, about 0.98 g/cm$^3$ to about 1.05 g/cm$^2$, or about 0.99 g/cm$^3$ to about 1.02 g/cm$^2$. Without being bound by any particular theory, it is believed that selection of regular (or medium) sulfur fuel oils with a density in the above ranges and/or modification of a regular (or medium) sulfur fuel to have a density in the above ranges can, in combination with other properties, provide a suitable ability to maintain solubility of asphaltenes to provide compatibility with low (or very low) sulfur fuel oils. Additionally or alternately, it is believed that using density as a property can provide a more convenient method for characterizing a fuel oil fraction, as compared with performing the distillation point measurements that can be needed to determine the average boiling point for determination of BMCI index.

Still another property that can additionally or alternatively be used for selection and/or modification of a regular (or medium) sulfur fuel oil is kinematic viscosity. In various aspects, a regular (or medium) sulfur fuel oil can be selected and/or modified to have a kinematic viscosity at ~50° C. of about 70 cSt to about 500 cSt or about 150 cSt to about 380 cSt. For example, the kinematic viscosity at ~50° C. of a regular (or medium) sulfur fuel oil (either as selected and/or as modified) can be about 70 cSt to about 500 cSt, about 100 cSt to about 500 cSt, about 130 cSt to about 500 cSt, about 150 cSt to about 500 cSt, about 170 cSt to about 500 cSt, about 190 cSt to about 500 cSt, about 210 cSt to about 500 cSt, about 230 cSt to about 500 cSt, about 250 cSt to about 500 cSt, about 270 cSt to about 500 cSt, about 290 cSt to about 500 cSt, about 300 cSt to about 500 cSt, about 350 cSt to about 500 cSt, about 400 cSt to about 500 cSt, about 70 cSt to about 450 cSt, about 100 cSt to about 450 cSt, about 130 cSt to about 450 cSt, about 150 cSt to about 450 cSt, about 170 cSt to about 450 cSt, about 190 cSt to about 450 cSt, about 210 cSt to about 450 cSt, about 230 cSt to about 450 cSt, about 250 cSt to about 450 cSt, about 270 cSt to about 450 cSt, about 290 cSt to about 450 cSt, about 300 cSt to about 450 cSt, about 350 cSt to about 450 cSt, about 70 cSt to about 400 cSt, about 100 cSt to about 400 cSt, about 130 cSt to about 400 cSt, about 150 cSt to about 400 cSt, about 170 cSt to about 400 cSt, about 190 cSt to about 400 cSt, about 210 cSt to about 400 cSt, about 230 cSt to about 400 cSt, about 250 cSt to about 400 cSt, about 270 cSt to about 400 cSt, about 290 cSt to about 400 cSt, about 300 cSt to about 400 cSt, about 70 cSt to about 380 cSt, about 100 cSt to about 380 cSt, about 130 cSt to about 380 cSt, about 150 cSt to about 380 cSt, about 170 cSt to about 380 cSt, about 190 cSt to about 380 cSt, about 210 cSt to about 380 cSt, about 230 cSt to about 380 cSt, about 250 cSt to about 380 cSt, about 270 cSt to about 380 cSt, about 290 cSt to about 380 cSt, about 300 cSt to about 380 cSt, about 70 cSt to about 360 cSt, about 100 cSt to about 360 cSt, about 130 cSt to about 360 cSt, about 150 cSt to about 360 cSt, about 170 cSt to about 360 cSt, about 190 cSt to about 360 cSt, about 210 cSt to about 360 cSt, about 230 cSt to about 360 cSt, about 250 cSt to about 360 cSt, about 270 cSt to about 360 cSt, about 290 cSt to about 360 cSt, about 300 cSt to about 360 cSt, about 70 cSt to about 340 cSt, about 100 cSt to about 340 cSt, about 130 cSt to about 340 cSt, about 150 cSt to about 340 cSt, about 170 cSt to about 340 cSt, about 190 cSt to about 340 cSt, about 210 cSt to about 340 cSt, about 230 cSt to about 340 cSt, about 250 cSt to about 340 cSt, about 270 cSt to about 340 cSt, about 290 cSt to about 340 cSt, about 300 cSt to about 340 cSt, about 70 cSt to about 320 cSt, about 100 cSt to about 320 cSt, about 130 cSt to about 320 cSt, about 150 cSt to about 320 cSt, about 170 cSt to about 320 cSt, about 190 cSt to about 320 cSt, about 210 cSt to about 320 cSt, about 230 cSt to about 320 cSt, about 250 cSt to about 320 cSt, about 270 cSt to about 320 cSt, about 70 cSt to about 300 cSt, about 100 cSt to about 300 cSt, about 130 cSt to about 300 cSt, about 150 cSt to about 300 cSt, about 170 cSt to about 300 cSt, about 190 cSt to about 300 cSt, about 210 cSt to about 300 cSt, about 230 cSt to about 300 cSt, about 250 cSt to about 300 cSt, about 70 cSt to about 280 cSt, about 100 cSt to about 280 cSt, about 130 cSt to about 280 cSt, about 150 cSt to about 280 cSt, about 170 cSt to about 280 cSt, about 190 cSt to about 280 cSt, about 210 cSt to about 280 cSt, about 230 cSt to about 280 cSt, about 70 cSt to about 260 cSt, about 100 cSt to about 260 cSt, about 130 cSt to about 260 cSt, about 150 cSt to about 260 cSt, about 170 cSt to about 260 cSt, about 190 cSt to about 260 cSt, about 210 cSt to about 260 cSt, about 70 cSt to about 240 cSt, about 100 cSt to about 240 cSt, about 130 cSt to about 240 cSt, about 150 cSt to about 240 cSt, about 170 cSt to about 240 cSt, about 190 cSt to about 240 cSt, about 70 cSt to about 220 cSt, about 100 cSt to about 220 cSt, about 130 cSt to about 220 cSt, about 150 cSt to about 220 cSt, about 170 cSt to about 220 cSt, about 70 cSt to about 200 cSt, about 100 cSt to about 200 cSt, about 130 cSt to about 200 cSt, about 150 cSt to about 200 cSt, about 70 cSt to about 150 cSt, or about 100 cSt to about 150 cSt. In particular, the kinematic viscosity at ~50° C. of a regular (or medium) sulfur fuel oil (either as selected and/or as modified) can be about 70 cSt to about 500 cSt, about 150 cSt to about 380 cSt, about 70 cSt to about 220 cSt, or about 210 cSt to about 500 cSt. Without being bound by any particular theory, it is believed that selection of regular (or medium) sulfur fuel oils with a kinematic viscosity at ~50° C. in the above ranges and/or modification of a regular (or medium) sulfur fuel to have a kinematic viscosity at ~50° C. in the above ranges can, in combination with other properties, provide a suitable ability to maintain solubility of asphaltenes to provide compatibility with low (or very low) sulfur fuel oils. Additionally or alternately, it is believed that using kinematic viscosity at ~50° C. as a property can provide a more convenient method for characterizing a fuel oil fraction, as compared with performing the distillation point measurements that can be needed to determine the average boiling point for determination of BMCI index.

Yet another property that can additionally or alternatively be used for selection and/or modification of a regular (or medium) sulfur fuel oil is toluene equivalence. The general method for determining toluene equivalence is noted above. In various aspects, a regular (or medium) sulfur fuel oil can be selected and/or modified to have a toluene equivalence of about 45 or less, for example about 40 or less, about 35 or less, about 30 or less, or about 25 or less. A selected and/or modified regular (or medium) sulfur fuel oil could have a toluene equivalence of as low as zero, but practically it can be more typical that a selected and/or modified regular sulfur fuel oil can have a toluene equivalence of at least about 5, for example at least about 10. In particular, the regular (or medium) sulfur fuel oil can be selected and/or modified to have a toluene equivalence of about 45 or less, of about 30 or less, from about 5 to about 45, from about 10 to about 35, or from about 10 to about 40.

Additionally or alternatively, one or more aspects of boiling point distribution can be used for selection and/or modification of a medium (or regular) sulfur fuel oil to improve/attain increased compatibility. A boiling point distribution of a composition can be described with reference to discrete points at which temperatures certain weight fractions (percentages) of the composition boil. These discrete points are cumulative, such that, in ramping up to a specified temperature, a certain weight percent of the composition will have cumulatively boiled. For instance, T10 would be the temperature at which 10 wt % of a composition has boiled.

Further additionally or alternatively, a medium (or low) sulfur fuel oil can be selected and/or modified to have a T0.5 of at least about 100° C., e.g., at least about 120° C., at least about 130° C., at least about 140° C., at least about 150° C., at least about 160° C., at least about 170° C., at least about 180° C., at least about 190° C., at least about 200° C., at least about 220° C., at least about 240° C., at least about 260° C., at least about 280° C., or at least about 300° C. Additionally or alternatively, a medium (or low) sulfur fuel oil can be selected and/or modified to have a T0.5 of up to about 320° C., e.g., up to about 300° C., up to about 280° C., up to about 260° C., up to about 240° C., up to about 220° C., up to about 200° C., up to about 190° C., up to about 180° C., up to about 170° C., up to about 160° C., up to about 150° C., up to about 140° C., up to about 130° C., or up to about 120° C. In particular, a medium (or low) sulfur fuel oil can be selected and/or modified to have a T0.5 of about 100° C. to about 220° C., about 190° C. to about 300° C., about 130° C. to about 240° C., or about 130° C. to about 200° C.

Still further additionally or alternatively, a medium (or low) sulfur fuel oil can be selected and/or modified to have a T10 of at least about 220° C., e.g., at least about 240° C., at least about 250° C., at least about 260° C., at least about 270° C., at least about 280° C., at least about 290° C., at least about 300° C., at least about 320° C., at least about 340° C., at least about 360° C., at least about 380° C., or at least about 400° C. Additionally or alternatively, a medium (or low) sulfur fuel oil can be selected and/or modified to have a T10 of up to about 420° C., e.g., up to about 400° C., up to about 380° C., up to about 360° C., up to about 340° C., up to about 320° C., up to about 300° C., up to about 290° C., up to about 280° C., up to about 270° C., up to about 260° C., up to about 250° C., or up to about 240° C. In particular, a medium (or low) sulfur fuel oil can be selected and/or modified to have a T10 of about 220° C. to about 320° C., about 220° C. to about 360° C., about 290° C. to about 420° C., or about 250° C. to about 320° C.

Yet further additionally or alternatively, a medium (or low) sulfur fuel oil can be selected and/or modified to have a T50 of at least about 300° C., e.g., at least about 330° C., at least about 350° C., at least about 370° C., at least about 390° C., at least about 410° C., at least about 430° C., at least about 450° C., at least about 470° C., at least about 490° C., at least about 510° C., at least about 530° C., or at least about 550° C. Additionally or alternatively, a medium (or low) sulfur fuel oil can be selected and/or modified to have a T50 of up to about 580° C., e.g., up to about 550° C., up to about 530° C., up to about 510° C., up to about 490° C., up to about 470° C., up to about 450° C., up to about 430° C., up to about 410° C., up to about 390° C., up to about 370° C., up to about 350° C., or up to about 330° C. In particular, a medium (or low) sulfur fuel oil can be selected and/or modified to have a T50 of about 300° C. to about 430° C., about 440° C. to about 580° C., about 330° C. to about 470° C., or about 390° C. to about 510° C.

Yet still further additionally or alternatively, a medium (or low) sulfur fuel oil can be selected and/or modified to have a T90 of at least about 360° C., e.g., at least about 390° C., at least about 420° C., at least about 450° C., at least about 480° C., at least about 510° C., at least about 540° C., at least about 570° C., at least about 600° C., at least about 630° C., at least about 660° C., at least about 680° C., or at least about 700° C. Additionally or alternatively, a medium (or low) sulfur fuel oil can be selected and/or modified to have a T90 of up to about 725° C., e.g., up to about 700° C., up to about 680° C., up to about 660° C., up to about 630° C., up to about 600° C., up to about 570° C., up to about 540° C., up to about 510° C., up to about 480° C., up to about 450° C., up to about 420° C., or up to about 390° C. In particular, a medium (or low) sulfur fuel oil can be selected and/or modified to have a T90 of about 360° C. to about 510° C., about 400° C. to about 570° C., about 600° C. to about 725° C., about 480° C. to about 660° C., or about 540° C. to about 700° C.

Any one or more of the above sets of properties can correspond to properties to allow a low (or very low) sulfur fuel oil, having a sulfur content of about 0.1 wt % or less, to be compatible with a regular (or medium) sulfur fuel oil, having a sulfur content of at least about 0.15 wt %. Typically, a regular sulfur fuel oil can have a sulfur content of at least about 1.0 wt %, for example at least about 1.5 wt %, or at least about 2.0 wt %, or at least about 2.5 wt %.

In some specific/alternative aspects, another potential situation where compatibility problems may occur is with very low sulfur fuel oil and medium sulfur fuel oil. As noted above, a very low sulfur fuel oil can correspond to a fuel oil with a sulfur content of about 500 wppm or less, while a medium sulfur fuel oil can correspond to a fuel oil having a sulfur content of about 500 wppm to about 5000 wppm.

A medium sulfur fuel oil (or alternatively a low sulfur fuel oil) can be manufactured by any convenient method. For example, a low sulfur crude slate can have a vacuum gas oil and/or vacuum resid fraction with a sulfur content of about 0.5 wt % or less. For a vacuum gas oil and/or vacuum resid fraction with a sulfur content of greater than about 0.5 wt %, hydroprocessing can be used to reduce the sulfur content of the fraction. Optionally, if desired, an additional refinery or crude fraction can be blended with the vacuum gas oil and/or vacuum resid fraction to modify the density, the sulfur, or any other desired property. Examples of suitable blending stocks can include, but are not necessarily limited to, cycle oils, coker gasoils, FCC bottoms fractions, other cracked distillate boiling range fraction, and/or other atmospheric and/or vacuum gas oil fractions (optionally after hydroprocessing).

In such specific/alternative aspects, an option for maintaining compatibility between a medium sulfur fuel oil and a very low sulfur fuel oil across all or substantially all possible blend ratios can be to select a medium sulfur fuel oil and/or modify a medium sulfur fuel oil to have a desired set of properties so that the medium sulfur fuel oil is compatible (at substantially all blend ratios) with a wide range of very low sulfur fuel oils. One factor in selecting a medium sulfur fuel oil and/or modifying a medium sulfur fuel oil for compatibility can be the asphaltene content. A medium sulfur fuel oil containing less than a maximum level of asphaltene content can be more likely to have an ability to maintain asphaltenes in solution when combined with a very low sulfur fuel oil. By combining a relatively high (near-maximum) asphaltene content with other general specifications for the properties of a medium sulfur fuel oil, a set of properties can be provided that will allow a medium sulfur fuel oil to be generally compatible with very low sulfur fuel oils.

With regard to asphaltene content, a medium sulfur fuel oil can be selected and/or modified to have an asphaltene content of about 5.5 wt % or less, for example about 5.0 wt % or less, about 4.5 wt % or less, about 4.0 wt % or less, about 3.5 wt % or less, about 3.0 wt % or less, or about 2.5 wt % or less, such as down to about 1.0 wt % or down to about 0.8 wt % (or less). In particular, a medium sulfur fuel oil can be selected and/or modified to have an asphaltene content of about 4.5 wt % or less, from about 1.0 wt % to about 5.5 wt %, or about 0.8 wt % to about 3.5 wt %

In addition to or as an alternative to characterizing the asphaltene content, another option can be to characterize the micro carbon residue (MCR) content of a fuel oil, such as determining MCR according to ISO 10370. A medium sulfur fuel oil can be selected and/or modified to have an MCR content of about 9.9 wt % or less, for example about 9.0 wt % or less, about 8.0 wt %, about 7.0 wt % or less, about 6.0 wt % or less, about 5.0 wt % or less, or about 4.5 wt % or less, such as down to about 2.0 wt % (or less). In particular, a medium sulfur fuel oil can be selected and/or modified to have an MCR content of about 6.0 wt % or less, from about 2.0 wt % to about 9.9 wt %, or from about 2.0 wt % to about 8.0 wt %.

Another property that can additionally or alternatively be used for selection and/or modification of a medium sulfur fuel oil is density. In various aspects, a medium sulfur fuel oil can be selected and/or modified to have a density at ~15° C. of about 0.88 g/cm$^3$ to about 0.99 g/cm$^3$. For example, the density of a medium sulfur fuel oil (either as selected and/or as modified) can be about 0.88 g/cm$^3$ to about 0.99 g/cm$^2$, about 0.88 g/cm$^3$ to about 0.98 g/cm$^3$, about 0.88 g/cm$^3$ to about 0.97 g/cm$^3$, about 0.88 g/cm$^3$ to about 0.96 g/cm$^3$, about 0.88 g/cm$^3$ to about 0.94 g/cm$^2$, about 0.88 g/cm$^3$ to about 0.92 g/cm$^3$, about 0.90 g/cm$^3$ to about 0.99 g/cm$^2$, about 0.90 g/cm$^3$ to about 0.98 g/cm$^3$, about 0.90 g/cm$^3$ to about 0.97 g/cm$^3$, about 0.90 g/cm$^3$ to about 0.96 g/cm$^3$, about 0.90 g/cm$^3$ to about 0.94 g/cm$^2$, about 0.92 g/cm$^3$ to about 0.99 g/cm$^2$, about 0.92 g/cm$^3$ to about 0.98 g/cm$^3$, about 0.92 g/cm$^3$ to about 0.97 g/cm$^3$, about 0.92 g/cm$^3$ to about 0.96 g/cm$^3$, about 0.92 g/cm$^3$ to about 0.94 g/cm$^2$, about 0.93 g/cm$^3$ to about 0.99 g/cm$^2$, about 0.93 g/cm$^3$ to about 0.98 g/cm$^3$, about 0.93 g/cm$^3$ to about 0.97 g/cm$^3$, about 0.93 g/cm$^3$ to about 0.96 g/cm$^3$, about 0.94 g/cm$^3$ to about 0.99 g/cm$^3$, about 0.94 g/cm$^3$ to about 0.98 g/cm$^3$, about 0.94 g/cm$^3$ to about 0.97 g/cm$^3$, about 0.95 g/cm$^3$ to about 0.99 g/cm$^3$, about 0.95 g/cm$^3$ to about 0.98 g/cm$^2$, or about 0.96 g/cm$^3$ to about 0.99 g/cm$^3$. In particular, the density of a medium sulfur fuel oil (either as selected and/or as modified) can be about 0.88 g/cm$^3$ to about 0.99 g/cm$^2$, about 0.88 g/cm$^3$ to about 0.94 g/cm$^3$, or about 0.93 g/cm$^3$ to about 0.99 g/cm$^3$.

Still another property that can additionally or alternatively be used for selection and/or modification of a medium sulfur fuel oil is kinematic viscosity. In various aspects, a medium sulfur fuel oil can be selected and/or modified to have a kinematic viscosity at ~50° C. of about 4.5 cSt to about 220 cSt. For example, the kinematic viscosity at ~50° C. of a regular sulfur fuel oil (either as selected and/or as modified) can be about 4.5 cSt to about 220 cSt, about 10 cSt to about 220 cSt, about 25 cSt to about 220 cSt, about 50 cSt to about 220 cSt, about 70 cSt to about 220 cSt, about 90 cSt to about 220 cSt, about 110 cSt to about 220 cSt, about 130 cSt to about 220 cSt, about 150 cSt to about 220 cSt, about 170 cSt to about 220 cSt, about 70 cSt to about 200 cSt, about 90 cSt to about 200 cSt, about 110 cSt to about 200 cSt, about 130 cSt to about 200 cSt, about 150 cSt to about 200 cSt, about 4.5 cSt to about 180 cSt, about 10 cSt to about 180 cSt, about 25 cSt to about 180 cSt, about 50 cSt to about 180 cSt, about 70 cSt to about 180 cSt, about 90 cSt to about 180 cSt, about 110 cSt to about 180 cSt, about 130 cSt to about 180 cSt, about 4.5 cSt to about 160 cSt, about 10 cSt to about 1620 cSt, about 25 cSt to about 160 cSt, about 50 cSt to about 160 cSt, about 70 cSt to about 160 cSt, about 90 cSt to about 160 cSt, about 110 cSt to about 160 cSt, about 4.5 cSt to about 140 cSt, about 10 cSt to about 140 cSt, about 25 cSt to about 140 cSt, about 50 cSt to about 140 cSt, about 70 cSt to about 140 cSt, about 90 cSt to about 140 cSt, about 4.5 cSt to about 120 cSt, about 10 cSt to about 120 cSt, about 25 cSt to about 120 cSt, about 50 cSt to about 120 cSt, about 70 cSt to about 120 cSt, about 4.5 cSt to about 70 cSt, about 10 cSt to about 70 cSt, about 25 cSt to about 70 cSt, about 4.5 cSt to about 40 cSt, or about 10 cSt to about 40 cSt. In particular, the kinematic viscosity at ~50° C. of a regular sulfur fuel oil (either as selected and/or as modified) can be about 4.5 cSt to about 220 cSt, about 4.5 cSt to about 70 cSt, or about 70 cSt to about 220 cSt.

Yet another property that can additionally or alternatively be used for selection and/or modification of a medium sulfur fuel oil is toluene equivalence. The general method for determining toluene equivalence is noted above. In various aspects, a medium sulfur fuel oil can be selected and/or modified to have a toluene equivalence of about 40 or less, for example about 35 or less, about 30 or less, or about 25 or less. A selected and/or modified medium sulfur fuel oil could have a toluene equivalence of as low as zero, but practically it can be more typical that a selected and/or modified medium sulfur fuel oil can have a toluene equivalence of at least about 5, for example at least about 10. In particular, a medium sulfur fuel oil can be selected and/or modified to have a toluene equivalence of about 40 or less, of about 30 or less, from about 5 to about 25, or from about 10 to about 35.

In still other aspects, one option for maintaining compatibility between a very low sulfur fuel oil and a medium sulfur fuel oil across all or substantially all possible blend ratios can be to select a very low sulfur fuel oil and/or modify a very low sulfur fuel oil to have a desired set of properties, so that the very low sulfur fuel oil is compatible (e.g., at substantially all blend ratios) with a wide range of medium sulfur fuel oils. One factor in selecting a very low sulfur fuel oil and/or modifying a very low sulfur fuel oil for compatibility can be the asphaltene content. A very low sulfur fuel oil containing at least a minimum level of asphaltene content can be more likely to have an ability to maintain asphaltenes from a medium sulfur fuel oil in solution. By combining a relatively low (near-minimum) asphaltene content with other general specifications for the properties of a low sulfur fuel oil, a set of properties can be provided that will allow a very low sulfur fuel oil to be generally compatible with medium sulfur fuel oils.

With regard to asphaltene content, a very low sulfur fuel oil can be selected and/or modified to have an asphaltene content of at least about 0.5 wt %, for example at least about 0.6 wt %, at least about 1.0 wt %, at least about 1.2 wt %, at least about 1.5 wt %, at least about 1.7 wt %, at least about 2.0 wt %, at least about 2.2 wt %, or at least about 2.5 wt %, such as up to about 4.0 wt % (or more). In particular, a very low sulfur fuel oil can be selected and/or modified to have an asphaltene content of at least about 0.5 wt %, at least about 1.0 wt %, from about 0.6 wt % to about 4.0 wt %, or from about 0.5 wt % to about 2.0 wt %.

In addition to or as an alternative to characterizing the asphaltene content, another option can be to characterize the micro carbon residue (MCR) content of a fuel oil, such as determining MCR according to ISO 10370. A very low sulfur fuel oil can be selected to have and/or modified to have an MCR content of at least about 0.75 wt %, for example at least about 1.2 wt %, at least about 1.5 wt %, at least about 2.0 wt %, at least about 2.5 wt %, at least about 3.0 wt %, at least about 3.5 wt %, at least about 4.0 wt %, or at least about 4.5 wt %, such as up to about 6.5 wt % (or more). In particular, a very low sulfur fuel oil can be selected to have and/or modified to have an MCR content of at least about 0.75 wt %, at least about 1.5 wt %, from about 0.75 wt % to about 6.5 wt %, or from about 1.5 wt % to about 6.5 wt %.

Another property that can additionally or alternatively be used for selection and/or modification of a very low sulfur fuel oil is density. In various aspects, a very low sulfur fuel oil can be selected to have and/or modified to have a density of about 0.86 g/cm$^3$ to about 0.95 g/cm$^3$ at ~15° C. For example, the density of a very low sulfur fuel oil at ~15° C. (either as selected and/or as modified) can be about 0.86 g/cm$^3$ to about 0.95 g/cm$^2$, for example about 0.86 g/cm$^3$ to about 0.94 g/cm$^3$, about 0.86 g/cm$^3$ to about 0.93 g/cm$^3$, about 0.86 g/cm$^3$ to about 0.92 g/cm$^2$, about 0.86 g/cm$^3$ to about 0.91 g/cm$^3$, about 0.86 g/cm$^3$ to about 0.90 g/cm$^3$, about 0.86 g/cm$^3$ to about 0.89 g/cm$^3$, about 0.87 g/cm$^3$ to about 0.95 g/cm$^2$, about 0.87 g/cm$^3$ to about 0.94 g/cm$^3$, about 0.87 g/cm$^3$ to about 0.93 g/cm$^3$, about 0.87 g/cm$^3$ to about 0.92 g/cm$^2$, about 0.87 g/cm$^3$ to about 0.91 g/cm$^3$, about 0.87 g/cm$^3$ to about 0.90 g/cm$^3$, about 0.87 g/cm$^3$ to about 0.89 g/cm$^3$, about 0.88 g/cm$^3$ to about 0.95 g/cm$^2$, about 0.88 g/cm$^3$ to about 0.94 g/cm$^3$, about 0.88 g/cm$^3$ to about 0.93 g/cm$^3$, about 0.88 g/cm$^3$ to about 0.92 g/cm$^2$, about 0.88 g/cm$^3$ to about 0.91 g/cm$^3$, about 0.88 g/cm$^3$ to about 0.90 g/cm$^3$, about 0.89 g/cm$^3$ to about 0.95 g/cm$^2$, about 0.89 g/cm$^3$ to about 0.94 g/cm$^3$, about 0.89 g/cm$^3$ to about 0.93 g/cm$^3$, about 0.89 g/cm$^3$ to about 0.92 g/cm$^2$, about 0.89 g/cm$^3$ to about 0.91 g/cm$^3$, about 0.90 g/cm$^3$ to about 0.95 g/cm$^2$, about 0.90 g/cm$^3$ to about 0.94 g/cm$^3$, about 0.90 g/cm$^3$ to about 0.93 g/cm$^3$, or about 0.90 g/cm$^3$ to about 0.92 g/cm$^3$. In particular, the density of a very low sulfur fuel oil at ~15° C. (either as selected and/or as modified) can be about 0.86 g/cm$^3$ to about 0.95 g/cm$^2$, about 0.88 g/cm$^3$ to about 0.95 g/cm$^2$, about 0.86 g/cm$^3$ to about 0.90 g/cm$^3$, or about 0.90 g/cm$^3$ to about 0.95 g/cm$^3$.

Still another property that can additionally or alternatively be used for selection and/or modification of a very low sulfur fuel oil is kinematic viscosity. In this discussion, kinematic viscosity for a fuel oil at ~50° C. is used, but it is understood that any other convenient kinematic viscosity measurement could also be used to characterize a fuel oil sample. In various aspects, a very low sulfur fuel oil can be selected and/or modified to have a kinematic viscosity at ~50° C. of about 15 cSt to about 200 cSt. For example, the kinematic viscosity at ~50° C. of a very low sulfur fuel oil (either as selected and/or as modified) can be about 15 cSt to about 200 cSt, about 15 cSt to about 180 cSt, about 15 cSt to about 160 cSt, about 15 cSt to about 150 cSt, about 15 cSt to about 140 cSt, about 15 cSt to about 130 cSt, about 15 cSt to about 120 cSt, about 15 cSt to about 110 cSt, about 15 cSt to about 100 cSt, about 15 cSt to about 90 cSt, about 15 cSt to about 80 cSt, about 15 cSt to about 70 cSt, about 15 cSt to about 60 cSt, about 15 cSt to about 50 cSt, about 20 cSt to about 200 cSt, about 20 cSt to about 180 cSt, about 20 cSt to about 160 cSt, about 20 cSt to about 150 cSt, about 20 cSt to about 140 cSt, about 20 cSt to about 130 cSt, about 20 cSt to about 120 cSt, about 20 cSt to about 110 cSt, about 20 cSt to about 100 cSt, about 20 cSt to about 90 cSt, about 20 cSt to about 80 cSt, about 20 cSt to about 70 cSt, about 20 cSt to about 60 cSt, about 20 cSt to about 50 cSt, about 25 cSt to about 200 cSt, about 25 cSt to about 180 cSt, about 25 cSt to about 160 cSt, about 25 cSt to about 150 cSt, about 25 cSt to about 140 cSt, about 25 cSt to about 130 cSt, about 25 cSt to about 120 cSt, about 25 cSt to about 110 cSt, about 25 cSt to about 100 cSt, about 25 cSt to about 90 cSt, about 25 cSt to about 80 cSt, about 25 cSt to about 70 cSt, about 25 cSt to about 60 cSt, about 25 cSt to about 50 cSt, about 35 cSt to about 200 cSt, about 35 cSt to about 180 cSt, about 35 cSt to about 160 cSt, about 35 cSt to about 150 cSt, about 35 cSt to about 140 cSt, about 35 cSt to about 130 cSt, about 35 cSt to about 120 cSt, about 35 cSt to about 110 cSt, about 35 cSt to about 100 cSt, about 35 cSt to about 90 cSt, about 35 cSt to about 80 cSt, about 35 cSt to about 70 cSt, about 35 cSt to about 60 cSt, about 45 cSt to about 200 cSt, about 45 cSt to about 180 cSt, about 45 cSt to about 160 cSt, about 45 cSt to about 150 cSt, about 45 cSt to about 140 cSt, about 45 cSt to about 130 cSt, about 45 cSt to about 120 cSt, about 45 cSt to about 110 cSt, about 45 cSt to about 100 cSt, about 45 cSt to about 90 cSt, about 45 cSt to about 80 cSt, about 45 cSt to about 70 cSt, about 55 cSt to about 200 cSt, about 55 cSt to about 180 cSt, about 55 cSt to about 160 cSt, about 55 cSt to about 150 cSt, about 55 cSt to about 140 cSt, about 55 cSt to about 130 cSt, about 55 cSt to about 120 cSt, about 55 cSt to about 110 cSt, about 55 cSt to about 100 cSt, about 55 cSt to about 90 cSt, about 55 cSt to about 80 cSt, about 65 cSt to about 200 cSt, about 65 cSt to about 180 cSt, about 65 cSt to about 160 cSt, about 65 cSt to about 150 cSt, about 65 cSt to about 140 cSt, about 65 cSt to about 130 cSt, about 65 cSt to about 120 cSt, about 65 cSt to about 110 cSt, about 65 cSt to about 100 cSt, about 65 cSt to about 90 cSt, about 75 cSt to about 200 cSt, about 75 cSt to about 180 cSt, about 75 cSt to about 160 cSt, about 75 cSt to about 150 cSt, about 75 cSt to about 140 cSt, about 75 cSt to about 130 cSt, about 75 cSt to about 120 cSt, about 75 cSt to about 110 cSt, about 75 cSt to about 100 cSt, about 85 cSt to about 200 cSt, about 85 cSt to about 180 cSt, about 85 cSt to about 160 cSt, about 85 cSt to about 150 cSt, about 85 cSt to about 140 cSt, about 85 cSt to about 130 cSt, about 85 cSt to about 120 cSt, about 85 cSt to about 110 cSt, about 95 cSt to about 200 cSt, about 95 cSt to about 180 cSt, about 95 cSt to about 160 cSt, about 95 cSt to about 150 cSt, about 95 cSt to about 140 cSt, about 95 cSt to about 130 cSt, about 95 cSt to about 120 cSt, about 105 cSt to about 200 cSt, about 105 cSt to about 180 cSt, about 105 cSt to about 160 cSt, about 105 cSt to about 150 cSt, about 115 cSt to about 200 cSt, about 115 cSt to about 180 cSt, about 105 cSt to about 140 cSt, about 105 cSt to about 130 cSt, about 115 cSt to about 160 cSt, about 115 cSt to about 150 cSt, about 115 cSt to about 140 cSt, about 125 cSt to about 200 cSt, about 125 cSt to about 180 cSt, about 125 cSt to about 160 cSt, or about 125 cSt to about 150 cSt. In particular, a very low sulfur fuel oil can be selected and/or modified to have a kinematic viscosity at ~50° C. of about 15 cSt to about 200 cSt, about 20 cSt to about 150 cSt, about 15 cSt to about 70 cSt, or about 85 cSt to about 200 cSt.

Yet another property that can additionally or alternatively be selected and/or modified for a very low sulfur fuel oil is BMCI index. In various aspects, the BMCI index for a very low sulfur fuel oil can be about 30 to about 110, for example about 40 to about 110, about 50 to about 110, about 60 to about 110, about 70 to about 110, about 80 to about 110, about 30 to about 100, about 40 to about 100, about 50 to about 100, about 60 to about 100, about 70 to about 100, about 30 to about 90, about 40 to about 90, about 50 to about 90, about 60 to about 90, about 30 to about 80, about 40 to about 80, about 50 to about 80, about 40 to about 70, or about 30 to about 70. In particular, the BMCI index for a very low sulfur fuel oil can be about 30 to about 110, about 30 to about 80, or about 30 to about 70.

In certain embodiments, fuel oil compositions having increased compatibility according to the invention can advantageously exhibit at least one, at least two, at least three, at least four, at least five, at least six, at least seven, or all of: a BMCI index from about 40 to about 100; a difference between a BMCI index and a TE value of about 15 to about 50; an asphaltene content from about 1.0 wt % to about 5.5 wt %; an MCR content from about 2.0 wt % to about 8.0 wt %; a sulfur content from about 4000 wppm to about 5000 wppm; a boiling point distribution wherein a T0.5 is about 100° C. to about 220° C., a T10 is about 220° C. to about 320° C., a T50 is about 300° C. to about 430° C., and/or a T90 is about 360° C. to about 510° C.; a density at 15° C. of about 0.88 g/cm$^3$ to about 0.99 g/cm$^3$; and a kinematic viscosity at 50° C. of about 4.5 cSt to about 220 cSt. In such embodiments, one or more of the aforementioned properties can be selected from the descriptions of desirable properties relating to medium sulfur fuel oils herein.

In some embodiments, fuel oil compositions having increased compatibility according to the invention can advantageously exhibit at least one, at least two, at least three, at least four, at least five, at least six, at least seven, or all of: a BMCI index from about 30 to about 80; a difference between a BMCI index and a TE value of about 15 to about 40; an asphaltene content from about 1.0 wt % to about 4.0 wt %; an MCR content from about 3.0 wt % to about 10.0 wt %; a sulfur content from about 900 wppm to about 1000 wppm; a boiling point distribution wherein a T0.5 is about 130° C. to about 240° C., a T10 is about 220° C. to about 360° C., a T50 is about 330° C. to about 470° C., and/or a T90 is about 400° C. to about 570° C.; a density at 15° C. of about 0.87 g/cm$^3$ to about 0.95 g/cm$^3$; and a kinematic viscosity at 50° C. of about 20 cSt to about 150 cSt. In such embodiments, one or more of the aforementioned properties can be selected from the descriptions of desirable properties relating to low (or very low) sulfur fuel oils herein.

Fuel oil compositions according to the invention can attain the aforementioned properties during refining and/or separation steps or alternatively through post-refining/separation modification processes, as noted herein. Such post-refining/separation modification processes should be understood to be separate and distinct from the additization process.

Modification of Fuel Oil Properties

In various aspects, the compatibility of a potential fuel oil with other types of fuel oils can be improved by modifying the potential fuel oil. Modifying a fuel oil to improve compatibility can include, but is not limited to, performing catalytic processing on the fuel oil; performing a thermal process on the fuel oil, such as a thermal separation (including vacuum distillation); performing a solvent separation of the fuel oil; adding one or more refinery streams, petroleum fractions, additives, and/or other input streams to the fuel oil; or a combination thereof.

Catalytic processing of a fuel oil to modify the fuel oil can be valuable for reducing the asphaltene content of the fuel oil. Catalytic processing can potentially be useful, for example, for modifying the properties of a regular sulfur fuel oil for compatibility with a low sulfur fuel oil, and/or for modifying the properties of a medium sulfur fuel oil for compatibility with a very low sulfur fuel oil. Catalytic processing can include various types of hydroprocessing, such as hydrotreatment, hydrocracking, and/or catalytic dewaxing, inter alia.

Hydrotreatment can typically be used to reduce the sulfur, nitrogen, and/or aromatic content of a feed. The catalysts used for hydrotreatment can include conventional hydroprocessing catalysts, such as those that comprise at least one Group VIII non-noble metal (from Columns 8-10 of IUPAC periodic table), for example Fe, Co, and/or Ni (such as Co and/or Ni), and at least one Group VIB metal (from Column 6 of IUPAC periodic table), for example Mo and/or W. Such hydroprocessing catalysts can optionally include transition metal sulfides. These catalytically active metals or mixtures of metals can typically be present as oxides, sulfides, or the like, on supports such as refractory metal oxides. Suitable metal oxide supports can include low acidic oxides such as silica, alumina, titania, silica-titania, and titania-alumina, inter alia. Suitable aluminas can include porous aluminas (such as gamma or eta) having: average pore sizes from about 50 Å to about 200 Å, e.g., from about 75 Å to about 150 Å; a (BET) surface area from about 100 $m^2/g$ to about 300 $m^2/g$, e.g., from about 150 $m^2/g$ to about 250 $m^2/g$; and a pore volume from about 0.25 $cm^3/g$ to about 1.0 $cm^3/g$, e.g., from about 0.35 $cm^3/g$ to about 0.8 $cm^3/g$. The supports are, in certain embodiments, preferably not promoted with a halogen such as fluorine, as this can undesirably increase the acidity of the support.

The at least one Group VIII non-noble metal, as measured in oxide form, can typically be present in an amount ranging from about 2 wt % to about 40 wt %, for example from about 4 wt % to about 15 wt %. The at least one Group VIB metal, as measured in oxide form, can typically be present in an amount ranging from about 2 wt % to about 70 wt %, for example from about 6 wt % to about 40 wt % or from about 10 wt % to about 30 wt %. These weight percents are based on the total weight of the catalyst. Suitable catalysts can include CoMo (e.g., ~1-10% Co as oxide, ~10-40% Mo as oxide), NiMo (e.g., ~1-10% Ni as oxide, ~10-40% Mo as oxide), or NiW (e.g., ~1-10% Ni as oxide, ~10-40% W as oxide), supported on alumina, silica, silica-alumina, or titania.

Alternatively, the hydrotreating catalyst can include or be a bulk metal catalyst, or can include a combination of stacked beds of supported and bulk metal catalyst. By bulk metal, it is meant that the catalyst particles are unsupported and comprise about 30-100 wt % of at least one Group VIII non-noble metal and at least one Group VIB metal, based on the total weight of the bulk catalyst particles, calculated as metal oxides, which bulk catalyst particles can also have a (BET) surface area of at least 10 $m^2/g$. For example, a bulk catalyst composition can include one Group VIII non-noble metal and two Group VIB metals. In some embodiments, the molar ratio of Group VIB to Group VIII non-noble metals can range generally from about 10:1 to about 1:10. In embodiments where more than one Group VIB metal is present in the bulk catalyst particles, the ratio of the different Group VIB metals is generally not critical. The same can hold when more than one Group VIII non-noble metal is present. Nevertheless, in embodiments where molybdenum and tungsten are present as Group VIB metals, the Mo:W ratio can preferably be in the range from about 9:1 to about 1:9.

Optionally, a bulk metal hydrotreating catalyst can have a surface area of at least 50 $m^2/g$, for example at least 100 $m^2/g$. Additionally or alternately, bulk metal hydrotreating catalysts can have a pore volume of about 0.05 ml/g to about 5 ml/g, for example about 0.1 ml/g to about 4 ml/g, about 0.1 ml/g to about 3 ml/g, or about 0.1 ml/g to about 2 ml/g, as determined by nitrogen adsorption. Bulk metal hydrotreating catalyst particles can additionally or alternatively have a median diameter of at least about 50 nm, e.g., at least about 100 nm, and/or a median diameter not more than about 5000 μm, e.g., not more than about 3000 μm. In an embodiment, the median particle diameter can be in the range of about 0.1 μm to about 50 μm, preferably about 0.5 μm to about 50 μm.

In typical embodiments, hydrotreating conditions can include: temperatures of about 200° C. to about 450° C., for example about 315° C. to about 425° C.; pressures of about 250 psig (~1.8 MPag) to about 5000 psig (~35 MPag), for example about 300 psig (~2.1 MPag) to about 3000 psig (~21 MPag); liquid hourly space velocities (LHSV) of about 0.1 $hr^{-1}$ to about 10 $hr^{-1}$; and hydrogen treat gas rates of about 200 scf/B (~36 $m^3/m^3$) to about 10000 scf/B (~1800 $m^3/m^3$), for example about 500 scf/B (~90 $m^3/m^3$) to about 10000 scf/B (~1800 $m^3/m^3$).

In some aspects, hydrocracking catalysts can contain sulfided base metals on acidic supports, such as amorphous silica-alumina, cracking zeolites, or other cracking molecular sieves such as USY or acidified alumina. In some preferred aspects, a hydrocracking catalyst can include at least one molecular sieve, such as a zeolite. Often these acidic supports can be mixed and/or bound with other metal oxides such as alumina, titania, and/or silica. Non-limiting examples of supported catalytic metals for hydrocracking catalysts can include combinations of Group VIB and/or Group VIII non-noble metals, including Ni, NiCoMo, CoMo, NiW, NiMo, and/or NiMoW. Support materials which may be used can comprise a refractory oxide material such as alumina, silica, alumina-silica, kieselguhr, diatomaceous earth, magnesia, zirconia, or combinations thereof, with alumina, silica, and/or silica-alumina being the most common (and preferred, in some embodiments).

In such hydrocracking catalysts, the at least one Group VIII non-noble metal, as measured in oxide form, can be present in an amount typically ranging from about 2 wt % to about 40 wt %, e.g., from about 4 wt % to about 15 wt %. In such hydrocracking catalysts, the at least one Group VIB metal, as measured in oxide form, can additionally or alternatively be present in an amount typically ranging from about 2 wt % to about 70 wt %, e.g., for supported catalysts from about 6 wt % to about 40 wt % or from about 10 wt % to about 30 wt %. These weight percents are based on the total weight of the catalyst. In some aspects, suitable hydrocracking catalyst active metals can include NiMo, NiW, or NiMoW, typically supported.

Additionally or alternately, hydrocracking catalysts with noble metals can be used. Non-limiting examples of noble metal catalysts can include those based on Pt and/or Pd. When the hydrogenation metal on a hydrocracking catalyst comprises or is a noble metal, the amount of the noble metal can be at least about 0.1 wt %, based on the total weight of the catalyst, for example at least about 0.5 wt % or at least about 0.6 wt %. Additionally or alternately, the amount of the noble metal can be about 5.0 wt % or less, based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less.

In some aspects, a hydrocracking catalyst can include a large pore molecular sieve selective for cracking of branched hydrocarbons and/or cyclic hydrocarbons. Zeolite Y, such as ultrastable zeolite Y (USY), is an example of a zeolite molecular sieve selective for cracking of branched hydrocarbons and cyclic hydrocarbons. Depending on the situation, the silica to alumina ratio ($Si/Al_2$, measured as oxides) in a USY zeolite can be at least about 10, for example at least about 15, at least about 25, at least about 50, or at least about 100. Depending on the situation, the unit cell size for a USY zeolite can be about 24.50 Å or less, e.g., about 24.45 Å or less, about 24.40 Å or less, about 24.35 Å or less, or about 24.30 Å. In certain situations, a variety of other types of molecular sieves can be used in a hydrocracking catalyst, such as zeolite Beta and/or ZSM-5. Still other categories of suitable molecular sieves can include molecular sieves having 10-member ring pore channels and/or 12-member ring pore channels. Examples of molecular sieves having 10-member ring pore channels and/or 12-member ring pore channels can include molecular sieves having one or more of the following zeolite framework types: MRE, MTT, EUO, AEL, AFO, SFF, STF, TON, OSI, ATO, GON, MTW, SFE, SSY, and VET.

In various embodiments, the conditions selected for hydrocracking can depend on the desired level of conversion, the level of contaminants in the input feed to the hydrocracking stage, and potentially other factors. Suitable hydrocracking conditions can include temperatures of about 450° F. (~232° C.) to about 840° F. (~449° C.), for example about 450° F. (~232° C.) to about 800° F. (~427° C.), about 450° F. (~249° C.) to 750° F. (~399° C.), about 500° F. (260° C.) to about 840° F. (~449° C.), about 500° F. (~260° C.) to about 800° F. (~427° C.), or about 500° F. (~260° C.) to about 750° F. (~399° C.); hydrogen partial pressures from about 250 psig (~1.8 MPag) to about 5000 psig (~35 MPag); liquid hourly space velocities from about 0.05 $hr^{-1}$ to about 10 $hr^{-1}$; and hydrogen treat gas rates from about 36 $m^3/m^3$ (~200 scf/B) to about 1800 $m^3/m^3$ (~10000 scf/B). In other embodiments, the conditions can include temperatures in the range of about 500° F. (~260° C.) to about 815° F. (~435° C.), for example about 500° F. (~260° C.) to about 750° F. (~399° C.) or about 500° F. (~260° C.) to about 700° C. (~371° C.); hydrogen partial pressures from about 500 psig (~3.5 MPag) to about 3000 psig (~21 MPag); liquid hourly space velocities from about 0.2 $hr^{-1}$ to about 5 $hr^{-1}$; and hydrogen treat gas rates from about 210 $m^3/m^3$ (~1200 scf/B) to about 1100 $m^3/m^3$ (~6000 scf/B).

In some optional embodiments, a dewaxing catalyst can be used for dewaxing of a potential fuel oil. Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, ZSM-57, or a combination thereof (e.g., ZSM-23 and/or ZSM-48, or ZSM-48 and/or zeolite Beta). Optionally but preferably, molecular sieves selective for isomerization/dewaxing as opposed to cracking can be used, such as ZSM-48, zeolite Beta, and/or ZSM-23, inter alia. Additionally or alternately, the molecular sieve can comprise, consist essentially of, or be a 10-member ring 1-D molecular sieve, such as EU-1, ZSM-35 (or ferrierite), ZSM-11, ZSM-57, NU-87, SAPO-11, ZSM-48, ZSM-23, and/or ZSM-22. In some preferred embodiments, the dewaxing catalyst can include EU-2, EU-11, ZBM-30, ZSM-48, ZSM-23, isostructural versions thereof (e.g., Theta-1, NU-10, EU-13, KZ-1, and/or NU-23), and/or combinations or intergrowths thereof (particularly comprising or being ZSM-48). It should be noted that a ZSM-23 zeolite having a silica to alumina ratio from ~20:1 to ~40:1 can sometimes be referred to as SSZ-32. Optionally and in some embodiments preferably, the dewaxing catalyst can include a binder, such as alumina, titania, silica, silica-alumina, zirconia, or a combination thereof, (e.g., alumina and/or titania or silica and/or zirconia and/or titania).

In certain preferred embodiments, when dewaxing catalysts are used in processes according to the invention, such dewaxing catalysts can have a low ratio of silica to alumina. For example, for ZSM-48, the ratio of silica to alumina in the zeolite can be less than about 200:1, for example less than about 110:1, less than about 100:1, less than about 90:1, or less than about 80:1, optionally at least about 30:1, at least about 50:1, at least about 60:1, or at least about 70:1. In various embodiments, the ratio of silica to alumina in the dewaxing catalyst can be from about 30:1 to about 200:1, about 60:1 to about 110:1, or about 70:1 to about 100:1.

In various embodiments, the catalysts according to the invention can (further) include a metal hydrogenation component, which can typically include/be a Group VIB and/or Group VIII metal. Suitable combinations can include Ni/Co/Fe with Mo/W, e.g., NiMo or NiW. The amount of metal (from the metal hydrogenation component) in/on the catalyst can be at least about 0.1 wt % based on catalyst, e.g., at least about 0.15 wt %, at least about 0.2 wt %, at least about 0.25 wt %, at least about 0.3 wt %, or at least about 0.5 wt %, based on catalyst weight. Additionally or alternatively, the amount of metal (from the metal hydrogenation component) in/on the catalyst can be about 20 wt % or less, based on catalyst weight, e.g., about 10 wt % or less, about 5 wt % or less, about 2.5 wt % or less, or about 1 wt % or less.

Effective processing conditions in a catalytic dewaxing zone can include a temperature of about 200° C. to about 450° C., e.g., about 270° C. to about 400° C., a hydrogen partial pressure of about 1.8 MPag to about 35 MPag (~250 psig to ~5000 psig), e.g., about 4.8 MPag to about 21 MPag, and a hydrogen treat gas rate of about 36 $m^3/m^3$ (~200 scf/B) to about 1800 $m^3/m^3$ (~10000 scf/B), e.g., about 180 $m^3/m^3$ (~1000 scf/B) to about 900 $m^3/m^3$ (~5000 scf/B). In certain embodiments, the conditions can include temperatures in the range of about 600° F. (~343° C.) to about 815° F. (~435° C.), hydrogen partial pressures of about 500 psig (~3.5 MPag) to about 3000 psig (~21 MPag), and hydrogen treat gas rates of about 210 $m^3/m^3$ (~1200 scf/B) to about 1100 $m^3/m^3$ (~1200 scf/B). The LHSV can be from ~0.1 $hr^{-1}$ to ~10 $hr^{-1}$, such as from about 0.5 $hr^{-1}$ to about 5 $hr^{-1}$ and/or from about 1 $hr^{-1}$ to about 4 $hr^{-1}$.

Performing a solvent separation can provide another option for modifying a fuel oil. Solvent deasphalting is an example of a solvent separation. Solvent deasphalting can be suitable for reducing the asphaltene content of a fuel oil fraction.

Solvent deasphalting is a solvent extraction process. Typical solvents can include an alkane or other hydrocarbon containing ~3-7 carbons per molecule, e.g., propane, n-butane, isobutane, n-pentane, n-hexane, and/or n-heptane. Additionally or alternatively, other types of solvents may be suitable, such as supercritical fluids. During solvent deasphalting, a feed portion can be mixed with the solvent. Portions of the feed that are soluble in the solvent can then be extracted, leaving behind a residue with little or no solubility in the solvent. Typical solvent deasphalting conditions can include mixing a feedstock fraction with a solvent in a weight ratio from about 1:2 to about 1:10, such as from about 1:2 to about 1:8. Typical solvent deasphalting temperatures can range from about 40° C. to about 150° C. The pressure during a typical solvent deasphalting process can be from about 50 psig (~350 kPag) to about 500 psig (~3.5 MPag). Although these conditions are typical, a more gentle set of solvent deasphalting conditions may be suitable for modifying a fuel oil. For example, in some aspects, modifying a regular (or medium) sulfur fuel oil to be compatible with a low (or very low) sulfur fuel oil can be achieved while still allowing the resulting deasphalted regular (or medium) sulfur fuel oil to have an asphaltene content of 2.0 wt % or more, optionally up to about 5.0 wt %, up to about 6.0 wt %, or even up to about 8.0 wt %.

Still another option for modifying a fuel oil can be addition of one or more streams or additives to the fuel oil. Addition of streams can be used to add asphaltenes to a fuel oil, to add compatiblizing molecules other than asphaltenes, to modify the density of a fuel oil, to modify the viscosity of a fuel oil, to modify the solvation power of a fuel oil, or a combination thereof.

For a low (or very low) sulfur fuel oil, addition of a stream containing asphaltenes and/or heavier components could be beneficial for improving the BMCI index of the fuel oil. For example, bottoms fractions or other ~650° F.+ (~343° C.+) cycle oil fractions from a fluid catalytic cracking unit can have high values for $S_{BN}$ and/or BMCI index. Such fractions can also contain asphaltenes and may have sufficient density and/or viscosity to increase the overall density and/or viscosity of a low sulfur fuel oil or very low sulfur fuel oil.

Additionally or alternatively, one or more additives or fractions can be added to a fuel oil to improve the ability of a fuel oil to maintain asphaltenes in solution after blending with another fuel oil. For example, alkaryl sulfonic acids such as dodecylbenzene sulfonic acid have been reported as potential additives that can reduce the likelihood of asphaltene precipitation. BakerPetrolite™ PAO3042 is another example of a product sold as a potential asphaltene precipitation inhibitor. In some less preferred aspects, an arylsulfonic acid may be used. Such additives can be added to a fuel oil in an amount of about 5 wt % or less, e.g., from about 0.01 wt % to about 3 wt % or from about 0.1 wt % to about 2 wt %. Additionally or alternatively, other refinery and/or petroleum fractions can be added to a fuel oil. In addition to the FCC cycle oil or bottoms stream noted above, steam cracked gas oils may also have some dispersant benefits that can reduce and/or minimize asphaltene precipitation.

Still another option can additionally or alternatively be to blend a regular (or medium) sulfur fuel oil with one or more distillate boiling range (refinery) streams, e.g., to reduce the viscosity and/or density of the fuel oil. A distillate boiling range stream can refer to a distillate boiling range stream relative to either atmospheric or vacuum distillation, and therefore can correspond to a stream having a boiling range of at least about 400° F. (~204° C.) up to about 1050° F. (~566° C.). In some optional embodiments, the distillate boiling range can correspond to about 400° F. (~204° C.) to about 1050° F. (~566° C.), for example about 400° F. (~204° C.) to about 950° F. (~510° C.), about 400° F. (~204° C.) to about 850° F. (~454° C.), about 500° F. (~260° C.) to about 1050° F. (~566° C.), about 500° F. (~260° C.) to about 950° F. (~510° C.), about 500° F. (~260° C.) to about 850° F. (~454° C.), about 600° F. (~316° C.) to about 1050° F. (~566° C.), about 600° F. (~316° C.) to about 950° F. (~510° C.), or about 600° F. (~316° C.) to about 850° F. (454° C.). Blending a distillate stream with a fuel oil can advantageously reduce the overall asphaltene content, e.g., due to dilution of the fuel oil. The amount of distillate blended with a fuel oil can correspond to about 1 wt % to about 40 wt % of the final distillate/fuel oil blended product, for example at least about 5 wt %, at least about 10 wt %, and/or about 30 wt % or less.

As an example, a heavy cycle oil from a fluid catalytic cracking process and/or a heavy coker gas oil, optionally after hydrotreatment, can correspond to a distillate boiling range stream. Such a stream can then be blended with straight run and/or hydrotreated distillate fraction (atmospheric distillate and/or vacuum distillate) to form a fuel oil having a sulfur content below a desired value, such as a regular sulfur fuel oil, a medium sulfur fuel oil, a low sulfur fuel oil, or a very low sulfur fuel oil.

Yet another option can be to additionally or alternately combine a regular sulfur fuel oil with a crude fraction or refinery stream that can lower the toluene equivalence of the regular sulfur fuel oil. Steam cracked gas oils are exemplary of a refinery stream that can have this property.

ADDITIONAL EMBODIMENTS

Embodiment 1

A method for blending fuel oils, comprising: delivering a first fuel oil into a fuel delivery system for an engine, the first fuel oil having a sulfur content of 0.15 wt % to about 3.5 wt %, a first asphaltene content of at least about 6.0 wt %, a first BMCI value, and a first TE (Toluene Equivalency) value; and delivering a second fuel oil into the fuel delivery system for the engine, the second fuel oil having a sulfur content of about 0.1 wt % or less, a second asphaltene content at least about 3.5 wt % lower than the first asphaltene content, a density at 15° C. of about 0.87 g/cm$^3$ to about 0.95 g/cm$^3$, a kinematic viscosity at 50° C. of about 20 cSt to about 200 cSt (or about 20 cSt to about 150 cSt), a second BMCI value, and a second TE value.

Embodiment 2

A method for blending fuel oils, comprising: delivering a first fuel oil into a fuel delivery system for an engine, the first fuel oil having a sulfur content of 0.15 wt % to about 3.5 wt %, optionally at least about 0.3 wt % or at least about 0.5 wt %, an asphaltene content of about 5.0 wt % to about 8.0 wt %, a density at 15° C. of about 0.96 to about 1.05 g/cm$^3$, a kinematic viscosity at 50° C. of about 70 cSt to about 500 cSt (or about 150 cSt to about 380 cSt), a first BMCI value, and a first TE (Toluene Equivalency) value of about 40 or less; and delivering a second fuel oil into the fuel delivery system for an engine, the second fuel oil having a sulfur content of about 0.1 wt % or less, a second BMCI value, and a second TE value.

Embodiment 3

An improved method for blending fuel oils, wherein a first fuel oil has a first sulfur content of at least 0.15 wt %, a first asphaltene content, a first BMCI value, and a first TE (Toluene Equivalency) value, a difference between the first BMCI value and the first TE value being about 40 or less, and wherein a second fuel oil has a second sulfur content of less than about 0.1 wt %, a second asphaltene content, a second BMCI value, and a second TE value, the first asphaltene content being greater than the second asphaltene content, the first TE value being greater than about 0.75 times the second BMCI value, and wherein the first fuel oil is introduced into a fuel delivery system for an engine, and wherein the second fuel oil is introduced into the fuel delivery system for the engine, the first fuel oil and the second fuel oil being mixed within the fuel delivery system for the engine, the improvement comprising: modifying the second fuel oil to increase the second asphaltene content by at least about 0.5 wt %, the modified second fuel oil having a modified asphaltene content of at least about 2.5 wt %, of at least half of the first asphaltene content, or a combination thereof, the modified second fuel oil being introduced into the fuel delivery system for the engine after said modifying.

Embodiment 4

An improved method for blending fuel oils, wherein a first fuel oil has a first sulfur content of at least 0.15 wt %, a first asphaltene content of at least about 5.0 wt %, a first BMCI value, and a first TE (Toluene Equivalency) value, and wherein a second fuel oil has a second sulfur content of less than about 0.1 wt %, a second asphaltene content lower than the first asphaltene content by about 3.0 wt % or more, a second BMCI value, and a second TE value, and wherein the first fuel oil is introduced into a fuel delivery system for an engine, and wherein the second fuel oil is introduced into the fuel delivery system for the engine, the first fuel oil and the second fuel oil being mixed within the fuel delivery system for the engine, the improvement comprising: modifying the second fuel oil to increase the second asphaltene content by at least about 0.5 wt %, the modified second fuel oil having a modified asphaltene content of at least about 2.5 wt %, of at least half of the first asphaltene content, or a combination thereof, the modified second fuel oil being introduced into the fuel delivery system for the engine after said modifying.

Embodiment 5

The method of Embodiment 3 or Embodiment 4, wherein the improvement further comprises determining the second asphaltene content of the second fuel oil prior to modifying the second fuel oil.

Embodiment 6

An improved method for blending fuel oils, wherein a first fuel oil has a first sulfur content of at least 0.15 wt %, a first asphaltene content, a first BMCI value, and a first TE (Toluene Equivalency) value, a difference between the first BMCI value and the first TE value being about 40 or less, and wherein a second fuel oil has a second sulfur content of less than about 0.1 wt %, a second asphaltene content lower than the first asphaltene content, a second BMCI value, and a second TE value, the first TE value being greater than about 0.75 times the second BMCI value, and wherein the first fuel oil is introduced into a fuel delivery system for an engine, and wherein the second fuel oil is introduced into the fuel delivery system for the engine, the first fuel oil and the modified second fuel oil being mixed within the fuel delivery system for the engine, the improvement comprising: modifying the first fuel oil to decrease the first asphaltene content by at least about 0.5 wt %, the modified first fuel oil having a modified asphaltene content of about 5.0 wt % or less, of twice the second asphaltene content or less, or a combination thereof, the modified first fuel oil being introduced into the fuel delivery system for the engine after said modifying.

Embodiment 7

An improved method for blending fuel oils, wherein a first fuel oil has a first sulfur content of at least 0.15 wt %, a first asphaltene content of at least about 6.0 wt %, a first BMCI value, and a first TE (Toluene Equivalency) value, and wherein a second fuel oil has a second sulfur content of less than about 0.1 wt %, a second asphaltene content of about 0 wt % to about 2.0 wt %, a second BMCI value, and a second TE value, and wherein the first fuel oil is introduced into a fuel delivery system for an engine, and wherein the second fuel oil is introduced into the fuel delivery system for the engine, the first fuel oil and the modified second fuel oil being mixed within the fuel delivery system for the engine, the improvement comprising: modifying the first fuel oil to decrease the first asphaltene content by at least about 0.5 wt %, the modified first fuel oil having a modified asphaltene content of about 5.0 wt % or less, of twice the second asphaltene content or less, or a combination thereof, the first fuel oil being introduced into the fuel delivery system for the engine after said modifying.

Embodiment 8

The improved method of Embodiment 6 or Embodiment 7, wherein the improvement further comprises determining the first asphaltene content of the first fuel oil prior to modifying the first fuel oil.

Embodiment 9

A method for improving a compatibility of a second fuel oil with a first fuel oil, the first fuel oil having a sulfur content of at least 0.15 wt % and a difference between a first BMCI value and first TE (Toluene Equivalency) value of 40 or less, the first TE value being greater than about 0.75 times a second BMCI value of the second fuel oil, the first fuel oil having a first asphaltene content greater than a second asphaltene content of the second fuel oil, the method comprising: Either Option A) determining at least one of an asphaltene content, a density, or a kinematic viscosity of the second fuel oil, the second fuel oil having a sulfur content of less than about 0.1 wt %, the second BMCI value, and a second TE value; and modifying the second fuel oil to modify the determined at least one of the asphaltene content, the density, or the kinematic viscosity, the modified second fuel oil having an asphaltene content of at least about 2.5 wt %, a density at 15° C. of about 0.87 g/cm$^3$ to about 0.95 g/cm$^3$, and a kinematic viscosity at 50° C. of about 20 cSt to about 200 cSt (or about 20 cSt to about 150 cSt), Or Option B) determining at least one of the second asphaltene content, a density, and a kinematic viscosity of the second fuel oil, the second fuel oil having a sulfur content of less than about 0.1 wt %, the second BMCI value, and a second TE value; and modifying the second fuel oil to modify the determined second asphaltene content, density, and/or kinematic viscosity, the modified second fuel oil having an asphaltene content of at least about 2.5 wt %, a density at 15° C. of about 0.87 g/cm$^3$ to about 0.95 g/cm$^3$, and a kinematic viscosity at 50° C. of about 20 cSt to about 200 cSt (or about 20 cSt to about 150 cSt).

Embodiment 10

A method for improving a compatibility of a second fuel oil with a first fuel oil, the first fuel oil having a first asphaltene content of at least about 5.0 wt %, a sulfur content of at least 0.15 wt %, a first BMCI value of at least about 60, and at least one of a first TE value of at least 30 and a difference between the first BMCI value and the first TE value of 40 or less, the first asphaltene content being greater than a second asphaltene content of the second fuel oil, the method comprising: Either Option A) determining at least one of an asphaltene content, a density, or a kinematic viscosity of the second fuel oil, the second fuel oil having a sulfur content of less than about 0.1 wt %, an asphaltene content of about 2.0 wt % or less, a second BMCI value, and a second TE value; and modifying the second fuel oil to modify the determined at least one of the asphaltene content, the density, or the kinematic viscosity, the modified second fuel oil having an asphaltene content of at least about 2.5 wt %, a density at 15° C. of about 0.87 g/cm$^3$ to about 0.95 g/cm$^3$, and a kinematic viscosity at 50° C. of about 20 cSt to about 200 cSt (or about 20 cSt to about 150 cSt), Or Option B) determining at least one of the second asphaltene content, a density, and a kinematic viscosity of the second fuel oil, the second fuel oil having a sulfur content of less than about 0.1 wt %, an asphaltene content of about 2.0 wt % or less, a second BMCI value, and a second TE value; and modifying the second fuel oil to modify the determined second asphaltene content, density, and/or kinematic viscosity, the modified second fuel oil having an asphaltene content of at least about 2.5 wt %, a density at 15° C. of about 0.87 g/cm$^3$ to about 0.95 g/cm$^3$, and a kinematic viscosity at 50° C. of about 20 cSt to about 200 cSt (or about 20 cSt to about 150 cSt).

Embodiment 11

A method for improving a compatibility of a first fuel oil with a second fuel oil, the second fuel oil having a sulfur content of less than about 0.1 wt %, a second BMCI value, and a second TE (Toluene Equivalency) value, the first fuel oil having a first asphaltene content greater than a second asphaltene content of the second fuel oil, the method comprising: Either Option A) determining at least one of an asphaltene content, a density, or a kinematic viscosity of the first fuel oil, the first fuel oil having a sulfur content of at least about 0.1 wt %, a first BMCI value, and a first TE value, a difference between the first BMCI value and the first TE value being about 40 or less, the first TE value being greater than about 0.75 times the second BMCI value; and modifying the first fuel oil to modify the determined at least one of the asphaltene content, the density, or the kinematic viscosity, the modified first fuel oil having an asphaltene content of less than about 8.0 wt %, a density at 15° C. of about 0.96 to about 1.05 g/cm$^3$, a kinematic viscosity at 50° C. of about 70 cSt to about 500 cSt (or about 150 cSt to about 380 cSt), and a TE value of about 40 or less, Or Option B) determining at least one of the first asphaltene content, a density, and a kinematic viscosity of the first fuel oil, the first fuel oil having a sulfur content of at least 0.15 wt %, a first BMCI value, and a first TE value, a difference between the first BMCI value and the first TE value being about 40 or less, the first TE value being greater than about 0.75 times the second BMCI value; and modifying the first fuel oil to modify the determined first asphaltene content, density, and/or kinematic viscosity, the modified first fuel oil having an asphaltene content of less than about 8.0 wt %, a density at 15° C. of about 0.96 to about 1.05 g/cm$^3$, a kinematic viscosity at 50° C. of about 70 cSt to about 500 cSt (or about 150 cSt to about 380 cSt), and a TE value of about 40 or less.

Embodiment 12

A method for improving a compatibility of a first fuel oil with a second fuel oil, the second fuel oil having a second asphaltene content of about 2.0 wt % or less, a sulfur content of less than about 0.1 wt %, a second BMCI value of about 60 or less, and at least one of a second TE (Toluene Equivalency) value of less than about 10 and a difference between the second BMCI value and the second TE value of at least about 40, the first fuel oil having a first asphaltene content greater than the second asphaltene content of the second fuel oil, the method comprising: Either Option A) determining at least one of an asphaltene content, a density, or a kinematic viscosity of the first fuel oil, the first fuel oil having a sulfur content of at least about 0.1 wt %, an asphaltene content of at least about 8.0 wt %, a first BMCI value, and a first TE value; and modifying the first fuel oil to modify the determined at least one of the asphaltene content, the density, or the kinematic viscosity, the modified first fuel oil having an asphaltene content of less than about 8.0 wt %, a density at 15° C. of about 0.96 to about 1.05 g/cm$^3$, a kinematic viscosity at 50° C. of about 70 cSt to about 500 cSt (or about 150 cSt to about 380 cSt), and a TE of about 40 or less, Or Option B) determining at least one of the first asphaltene content, a density, and a kinematic viscosity of the first fuel oil, the first fuel oil having a sulfur content of at least 0.15 wt %, an asphaltene content of at least about 8.0 wt %, a first BMCI value, and a first TE value; and modifying the first fuel oil to modify the determined first asphaltene content, density, and/or kinematic viscosity, the modified first fuel oil having an asphaltene content of less than about 8.0 wt %, a density at 15° C. of about 0.96 to about 1.05 g/cm$^3$, a kinematic viscosity at 50° C. of about 70 cSt to about 500 cSt (or about 150 cSt to about 380 cSt), and a TE of about 40 or less.

Embodiment 13

The method of any of Embodiments 3-5, wherein the modified second fuel oil has an asphaltene content of at least about 2.5 wt %, a density at 15° C. of about 0.87 g/cm$^3$ to about 0.95 g/cm$^3$, and a kinematic viscosity at 50° C. of about 20 cSt to about 200 cSt (or about 20 cSt to about 150 cSt).

Embodiment 14

The method of any of Embodiments 6-8, wherein the modified first fuel oil has an asphaltene content of about 8.0 wt % or less, a density at 15° C. of about 0.96 to about 1.05 g/cm$^3$, a kinematic viscosity at 50° C. of about 70 cSt to about 500 cSt (or about 150 cSt to about 380 cSt), and a TE of about 40 or less.

Embodiment 15

The method of any of Embodiment 3-5 and 9-12, wherein the first fuel oil has a first asphaltene content of at least about 5.0 wt %, or at least about 6.0 wt %, or about 15 wt % or less, or a combination thereof.

Embodiment 16

The method of any of Embodiments 3, 6, 8, and 11, wherein the second fuel oil has a second asphaltene content of about 0 wt % to about 2.0 wt %.

Embodiment 17

The method of any of the above Embodiments, wherein a difference between the second BMCI value and the second TE value is greater than or equal to a difference between the first BMCI value and the first TE value.

Embodiment 18

The method of any of the above Embodiments, wherein a) the first sulfur content is about 0.3 wt % to about 3.5 wt %, or about 0.5 wt % to about 3.5 wt %, orb) the first sulfur content is 0.15 wt % to about 0.5 wt %, or c) the second sulfur content is about 1 wppm to about 1000 wppm (or about 1 wppm to about 500 wppm), or a combination thereof.

Embodiment 19

The method of any of Embodiments 3-18, wherein modifying the first fuel oil or modifying the second fuel oil comprises solvent deasphalting the first fuel oil or second fuel oil.

Embodiment 20

The method of any of Embodiments 3-19, wherein modifying the first fuel oil or modifying the second fuel oil comprises hydroprocessing the first fuel oil or hydroprocessing the second fuel oil, the hydroprocessing optionally comprising hydrotreating, hydrocracking, dewaxing, or a combination thereof.

Embodiment 21

The method of any of the above Embodiments, wherein the first asphaltene content is greater than the second asphaltene content by at least about 3.0 wt %, or at least about 3.5 wt %, or at least about 4.0 wt %, or at least about 4.5 wt %, or at least about 5.0 wt %, or at least about 5.5 wt %, or at least about 6.0 wt %, or at least about 6.5 wt %.

Embodiment 22

The method of any of Embodiments 3-21, wherein modifying the second fuel oil comprises blending the second fuel oil with a composition comprising at least about 50 wt % of one or more asphaltene-containing fractions, the composition optionally further comprising one or more distillate boiling range fractions, one or more viscosity modifying additives, or a combination thereof.

Embodiment 23

The method of any of Embodiments 3-22, wherein modifying the first fuel oil comprises blending the second fuel oil with a composition comprising a fluid catalytic cracking bottoms fraction, a fluid catalytic cracking cycle oil, a steam cracked gas oil, or a combination thereof.

Embodiment 24

The method of any of Embodiments 3-23, wherein modifying the first fuel oil or modifying the second fuel oil comprises adding an additive to the first fuel oil or adding an additive to the second fuel oil, the additive optionally comprising an alkaryl sulfonic acid.

Embodiment 25

The method of any of Embodiments 9-24, wherein determining at least one of the first asphaltene content, a density, or a kinematic viscosity of a first fuel oil or determining at least one of the second asphaltene content, a density, or a kinematic viscosity of a second fuel oil comprises determining a density at a temperature of about 0° C. to about 50° C., determining a kinematic viscosity at a temperature of about 0° C. to about 100° C., or a combination thereof. (Corresponds to Option A of Embodiments 9-12)

Embodiment 26

The method of any of Embodiments 9-24, wherein determining the first asphaltene content, second asphaltene content, density, and/or kinematic viscosity of a first fuel oil or a second fuel oil comprises determining a density at a temperature of about 0° C. to about 50° C., determining a kinematic viscosity at a temperature of about 0° C. to about 100° C., or a combination thereof. (Corresponds to Option B of Embodiments 9-12)

Embodiment 27

The method of any of Embodiments 3-26, further comprising characterizing, prior to modifying the first fuel oil or the second fuel oil, a toluene equivalency (TE) value for one or more blend ratios of the first fuel oil and the second fuel oil based on the relationship $$TE=\Sigma TE_i*A_i*y_i/\Sigma A_i*y_i$$

where $TE_i$ is the TE value of a component i, $y_i$ is the percentage of component i in a blend at a blend ratio, and $A_i$ is the asphaltene content of the component i.

Embodiment 28

The method of any of Embodiments 3-26, further comprising characterizing, after modifying at least one of the first fuel oil or the second fuel oil, a toluene equivalency (TE) value for one or more blend ratios of the first fuel oil and the second fuel oil based on the relationship $$TE=\Sigma TE_i*A_i*y_i/\Sigma A_i*y_i$$

where $TE_i$ is the TE value of a component i, $y_i$ is the percentage of component i in a blend at a blend ratio, and $A_i$ is the asphaltene content of the component i.

Embodiment 29

The method of Embodiment 27 or Embodiment 28, wherein each of the characterized one or more blend ratios has a (BMCI-TE) value of at least about 10, or at least about 14, or at least about 15.

Embodiment 30

The method of any of Embodiments 1-2, further comprising determining, prior to delivering at least one of the first fuel oil or the second fuel oil, a toluene equivalency (TE) value for one or more blend ratios of the first fuel oil and the second fuel oil based on the relationship $$TE=\Sigma TE_i*A_i*y_i/\Sigma A_i*y_i$$

where $TE_i$ is the TE value of a component i, $y_i$ is the percentage of component i in a blend at a blend ratio, and $A_i$ is the asphaltene content of the component i.

Embodiment 31

A marine or bunker fuel composition having increased compatibility with commercial marine or bunker fuels, said composition having at least one, at least two, at least three, at least four, at least five, at least six, at least seven, or all of the following enumerated properties: a BMCI index from about 40 to about 100; a difference between a BMCI index and a TE value of about 15 to about 50; an asphaltene content from about 1.0 wt % to about 5.5 wt %; an MCR content from about 2.0 wt % to about 8.0 wt %; a sulfur content from about 4000 wppm to about 5000 wppm; a boiling point distribution wherein a T0.5 is about 100° C. to about 220° C., a T10 is about 220° C. to about 320° C., a T50 is about 300° C. to about 430° C., and/or a T90 is about 360° C. to about 510° C.; a density at 15° C. of about 0.88 g/cm$^3$ to about 0.99 g/cm$^3$; and a kinematic viscosity at 50° C. of about 4.5 cSt to about 220 cSt.

Embodiment 32

A marine or bunker fuel composition having increased compatibility with commercial marine or bunker fuels, said composition having at least one, at least two, at least three, at least four, at least five, at least six, or all of the following properties: a BMCI index from about 30 to about 80; a difference between a BMCI index and a TE value of about 15 to about 40; an asphaltene content from about 1.0 wt % to about 4.0 wt %; an MCR content from about 3.0 wt % to about 10.0 wt %; a sulfur content from about 900 wppm to about 1000 wppm; a boiling point distribution wherein a T0.5 is about 130° C. to about 240° C., a T10 is about 220° C. to about 360° C., a T50 is about 330° C. to about 470° C., and/or a T90 is about 400° C. to about 570° C.; a density at 15° C. of about 0.87 g/cm$^3$ to about 0.95 g/cm$^3$; and a kinematic viscosity at 50° C. of about 20 cSt to about 150 cSt.

EXAMPLES

Example 1—Impact of Asphaltene Content on Fuel Compatibility

In this predictive example, a low sulfur fuel oil can be blended with three different regular sulfur fuel oils having similar properties but different asphaltene contents. In this predictive example, the low sulfur fuel oil (sulfur content of ~0.1 wt % or less) can have a BMCI value of ~53, a toluene equivalency (TE) of ~0, and an asphaltene content of ~0.67 wt %. The regular sulfur fuel oils (sulfur content from ~0.1 wt % to ~3.5 wt %) can have a BMCI value of ~83, a TE of ~63.5, and an asphaltene content of either ~0.67 wt %, ~3.0 wt %, or ~6.0 wt %.

FIG. 1 shows the BMCI and TE values for blends of the low sulfur fuel oil with the regular sulfur fuel oil having the three different asphaltene contents. The BMCI value for blends of the low sulfur fuel oil and regular sulfur fuel oil is shown by line 110 in FIG. 1. As shown in FIG. 1, the BMCI value is expected to vary in a roughly linear manner with the BMCI values of the components of a fuel oil blend. Line 120 shows the TE values for a blend of the low sulfur fuel oil and the regular sulfur fuel oil with ~0.67 wt % asphaltenes. Line 120 also seems to show a conventional linear behavior of the TE value relative to the component fuel oil TE values. However, based on the relationship in Equation (4) above, the regular sulfur fuel oils having ~3 wt % or ~6 wt % asphaltene content are predicted to result in blends with distinctly different behavior for TE values. Line 130 shows the predicted TE values for a blend with the ~3 wt % asphaltene regular sulfur fuel oil, while line 140 shows the predicted TE values for a blend with the ~6 wt % asphaltene regular sulfur fuel oil. As shown in FIG. 1, the disparity in asphaltene content between the fuel oils appears to result in much larger predicted TE values as the amount of low sulfur fuel oil in the blend decreases. As a result, the BMCI and TE values start to approach each other, with the smallest difference being predicted at a roughly 75% or 80% blend of low sulfur and regular sulfur fuel oil.

Example 2—Sediment from Blending of Fuel Oils

Figure 2:
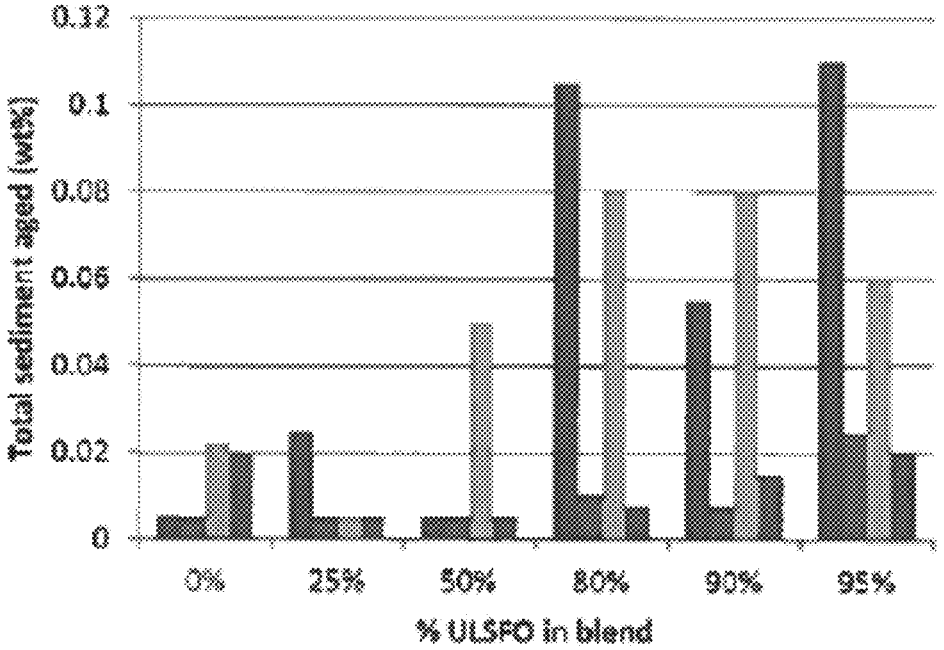
FIG. 2 shows sediment amounts from blends of various regular sulfur fuel oils with a low sulfur fuel oil at various blend ratios.

In this example, four different regular sulfur fuel oils were blended with a low sulfur fuel oil sample at blend ratios of ~0%, ~25%, ~50%, ~80%, ~90%, and ~95% of low sulfur fuel oil. The low sulfur fuel oil in the blends shown in FIG. 2 had an asphaltene content of about 0.5 wt %, while the regular sulfur fuel oils had various asphaltene contents. FIG. 2 shows a bar corresponding to the total sediment measured for samples aged according to ISO 10307-2 for each regular sulfur fuel oil at each blend ratio, with regular sulfur fuel oil 1 (RSFO 1) always being the left most bar, follow by RSFO 2, RSFO 3, and RSFO 4 progressively on the right. It is noted that the repeatability of this sediment measurement technique was on the order of ~0.03 wt %, so there appeared to be some variability in the data.

FIG. 2 generally shows that RSFO 2 and RSFO 4 appeared more compatible with the low sulfur fuel oil, while RSFO 1 and RSFO 3 appeared to have a lower compatibility, as indicated by the amount of sediment generated as the blend ratio increased up to ~80 wt % or ~90 wt % low sulfur fuel oil. The difference in the amount of sediment generated can be understood in conjunction with the BMCI and TE values for blends based on RSFO 3 and RSFO 4.

Figure 3:
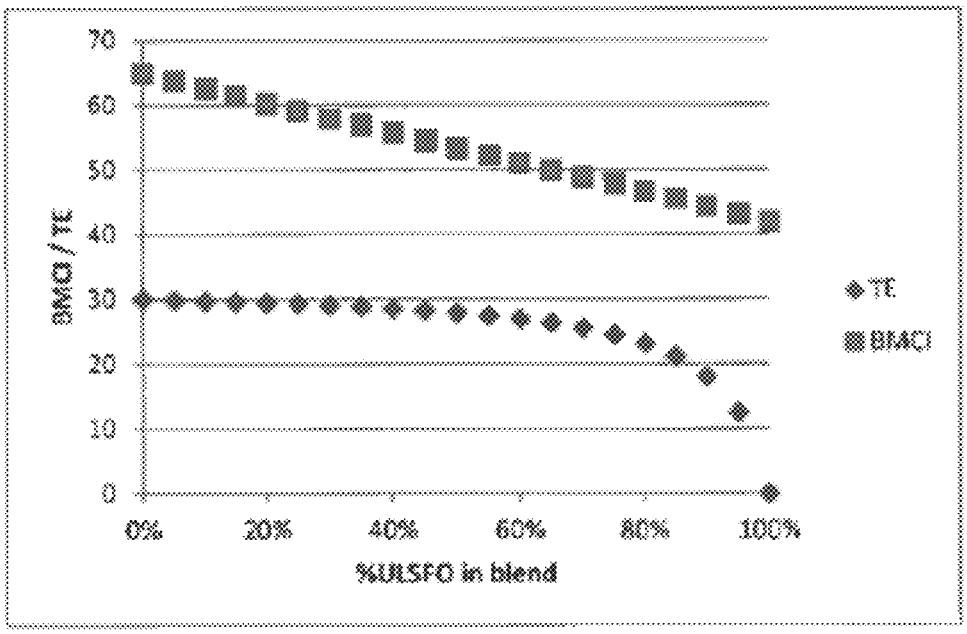
FIG. 3 shows BMCI and TE values for blends of a regular sulfur fuel oil and a low sulfur fuel oil.
Figure 4:
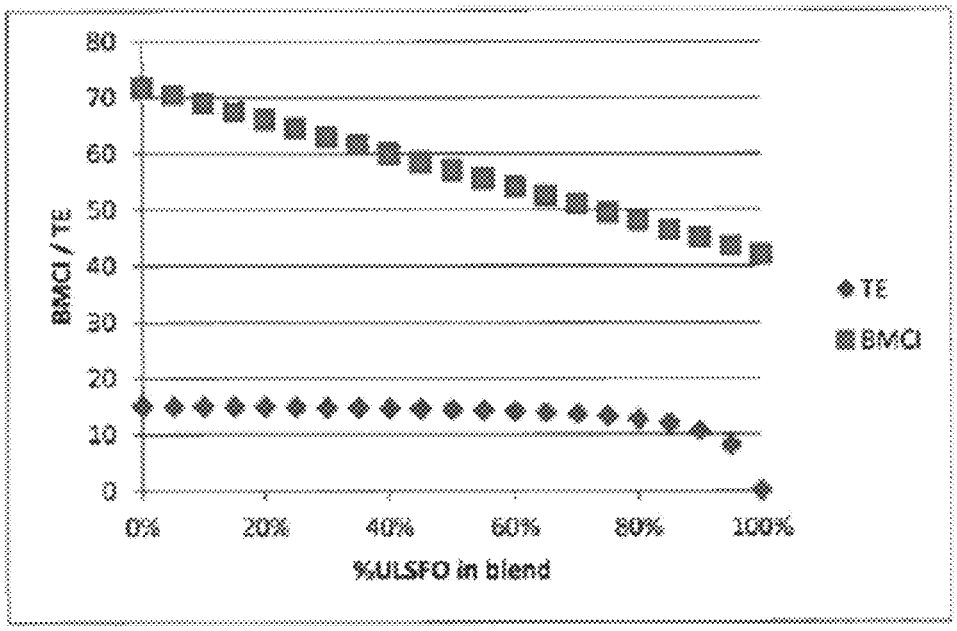
FIG. 4 shows BMCI and TE values for blends of a regular sulfur fuel oil and a low sulfur fuel oil.

FIG. 3 shows the difference between the BMCI and TE values as calculated using Equation (4) for blends of the low sulfur fuel oil and RSFO 3. Under a conventional view, little or no sediment would be expected at any blend ratio, as the TE value for RSFO 3 is at least ~10 lower than the BMCI value of the low sulfur fuel oil. According to the conventional view, with a linear relationship between the TE value of a blend and the percentage of low sulfur fuel oil in the blend, as the BMCI value of the blend decreases, the TE value would be expected to have a corresponding decrease. However, using Equation (4) to determine the TE value of a blend, the TE value for blends of RSFO 3 and the low sulfur fuel oil remains near ~30 for blends containing up to about 70% of the low sulfur fuel oil. While FIG. 3 shows that RSFO 3 and the low sulfur fuel oil should still effectively be compatible at all blend ratios, the difference between the BMCI and TE values at blends having about 60 wt % to about 80 wt % low sulfur fuel oil can be less than 20, which can lead to the early stages of substantial sediment formation. By contrast, FIG. 4 shows that for RSFO 4 and the low sulfur fuel oil, even after using Equation 1 to determine the TE values of the blends, the difference between the BMCI and TE values appears to be greater than about 20 at all blend ratios. This matches the low sediment amounts shown in FIG. 2 for the blends involving RSFO 4.

Example 3—Sediment from Blending of Fuel Oils

Example 2 was repeated but with Fuel Oil Y as the low sulfur fuel oil. Because of the increased asphaltene content in Fuel Oil Y, as well as the increased difference between BMCI and TE values, all the blends at all weight fractions has a total sediment aged (TSA) of 0.01 wt % or less. This comparison with Example 2 highlights the increased blend compatibility window for blend components having increased differences between BMCI and TE values and, in many cases, increased asphaltene contents Example 4—Examples of Fuel Oil Properties FIG. 5 shows various properties for four different regular sulfur fuel oils, labeled as Fuel Oils A-D. FIG. 6 shows various properties for four different low sulfur fuel oils (sulfur content less than about 0.1 wt %), labeled as Fuel Oils W-Z. In FIGS. 5 and 6, the properties shown for the various fuel oils include fractional weight distillation amounts for the fuel oils based on atmospheric and vacuum distillation. For the regular sulfur fuel oils, the weight percentage recovered was noted when a temperature of about 750° C. was reached, which was treated as the end point for the characterization by distillation for the fuel oils.

Other properties included density at about 15° C., kinematic viscosity at about 50° C., calculated carbon aromaticity index (CCAI), BMCI index, toluene equivalency, asphaltene content, and Conradson carbon residue. In FIG. 6, data boxes that are empty indicate a value that was not measured or obtained for the corresponding fuel oil.

Examples 5-8

For these Examples, FIG. 7 shows select physico-chemical properties of certain fuel oils and/or blendstocks used, and FIG. 8 shows greater detail of the boiling range profile of those fuel oils/blendstocks, as measured by the Simulated Distillation GC method listed in FIG. 7, with the exception of Fuel Oil EE, which was measured by ASTM D86. As in Example 3, the weight percentage recovered was noted when a temperature of about 750° C. was reached, which was treated as the end point for the characterization by distillation for the fuel oils, and data boxes that are empty indicate a value that was not measured or obtained for the corresponding fuel oil.

Fuel Oil AA appeared to have similar properties to Fuel Oil C in FIGS. 5-6. In FIG. 7, the Kinematic Viscosity value for Fuel Oil EE was measured at ~40° C., instead of at ~50° C.

The Spot Tests in Examples 5-8 were done according to ASTM D4740.

Example 5

In this Example, an RMG380 grade RSFO (Fuel Oil AA) was mixed with three other marine/bunker fuel blendstocks to determine compatibility. In each case, about 10 wt % of Fuel 1 (Fuel Oil AA) was used, and about 90 wt % of Fuel 2 was used. Table 1 below shows the details of the blendstocks and the results of their blending.

TABLE 1

| Fuel 1 | Fuel 2 | BMCI-TE | Compatibility (Predicted/Actual) | Total Sediment (wt %) | Spot Test |
|---|---|---|---|---|---|
| Fuel Oil AA | Fuel Oil BB | ~4 | No/No | ~0.02 | 3 |
| Fuel Oil AA | ~90 wt % Fuel Oil BB + ~10 wt % Fuel Oil CC | ~14 | Yes/Yes | ~0.02 | 2 |
| Fuel Oil AA | ~99 wt % Fuel Oil BB + ~1 wt % Fuel Oil DD | ~−3 | No/No | ~0.01 | 3 |

Example 6

In this Example, an RMG380 grade RSFO (Fuel Oil AA) was mixed with two other marine/bunker fuel blendstocks to determine compatibility. In both cases, about 10 wt % of Fuel 1 (Fuel Oil AA) was used, and about 90 wt % of Fuel 2 was used. Table 2 below shows the details of the blendstocks and the results of their blending.

TABLE 2

| Fuel 1 | Fuel 2 | BMCI-TE | Compatibility (Predicted/Actual) | Total Sediment (wt %) | Spot Test |
|---|---|---|---|---|---|
| Fuel Oil AA | Fuel Oil W | ~14 | No/No | ~0.02 | 3 |
| Fuel Oil AA | ~90 wt % Fuel Oil W + ~10 wt % Fuel Oil CC | ~24 | Yes/Yes | ~0.03 | 2 |

Example 7

In this Example, an RMG380 grade RSFO (Fuel Oil AA) was mixed with three other marine/bunker fuel blendstocks to determine compatibility. In the first two cases, about 10 wt % of Fuel 1 (Fuel Oil AA) was used, and about 90 wt % of Fuel 2 was used. In the third case, about 5 wt % of Fuel 1 (Fuel Oil AA) was used, and about 95 wt % of Fuel 2 was used. Table 3 below shows the details of the blendstocks and the results of their blending.

TABLE 3

| Fuel 1 | Fuel 2 | BMCI-TE | Compatibility (Predicted/Actual) | Total Sediment (wt %) | Spot Test |
|---|---|---|---|---|---|
| Fuel Oil AA | Fuel Oil EE | ~14 | No/Yes | ~0.02 | 2 |
| Fuel Oil AA | ~80 wt % Fuel Oil EE + ~20 wt % Fuel Oil FF | ~26 | Yes/Yes | ~0.02 | 1 |
| Fuel Oil AA | Fuel Oil EE | ~13 | No/Yes | — | 2 |

Example 8

In this Example, a ULSFO (Fuel Oil W) was mixed with four other marine/bunker fuel blendstocks to determine compatibility. In the first three cases, about 10 wt % of Fuel 1 was used, and about 90 wt % of Fuel 2 (Fuel Oil W) was used. In the fourth case, about 5 wt % of Fuel 1 was used, and about 95 wt % of Fuel 2 (Fuel Oil W) was used. Table 4 below shows the details of the blendstocks and the results of their blending.

TABLE 4

| Fuel 1 | Fuel 2 | BMCI-TE | Compatibility (Predicted/Actual) | Total Sediment (wt %) | Spot Test |
|---|---|---|---|---|---|
| Fuel Oil AA | Fuel Oil W | ~14 | No/Maybe | ~0.02 | 2/3 |
| ~60 wt % Fuel Oil AA + ~40 wt % Fuel Oil CC | Fuel Oil W | ~14 | Yes/Yes | ~0.02 | 2 |
| ~70 wt % Fuel Oil AA + ~30 wt % Fuel Oil BB | Fuel Oil W | ~−3 | No/No | ~0.02 | 3 |
| Fuel Oil AA | Fuel Oil W | ~13 | No/No | — | 4 |

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A marine or bunker fuel composition having increased compatibility with commercial marine or bunker fuels, said composition having at least five of the following enumerated properties:

a BMCI (Bureau of Mines Correlation Index) value from about 40 to about 100;

a difference between a BMCI value and a TE (Toluene Equivalency) value of about 15 to about 50;

an asphaltene content from about 1.0 wt % to about 5.5 wt %;

an MCR (Micro Carbon Residue) content from about 2.0 wt % to about 8.0 wt %;

a sulfur content from about 4000 wppm to about 5000 wppm;

a density at 15° C. of about 0.88 g/cm$^3$ to about 0.99 g/cm$^3$; and a kinematic viscosity at 50° C. of about 4.5 cSt to about 220 cSt.

2. The marine or bunker fuel composition of claim 1, having at least six of the enumerated properties.

3. The marine or bunker fuel composition of claim 1, having all of the enumerated properties.

4. A marine or bunker fuel composition having increased compatibility with commercial marine or bunker fuels, said composition having at least five of the following enumerated properties:

a BMCI (Bureau of Mines Correlation Index) value from about 30 to about 80;

a difference between a BMCI value and a TE (Toluene Equivalency) value of about 15 to about 40;

an asphaltene content from about 0.6 wt % to about 4.0 wt %;

an MCR (Micro Carbon Residue) content from about 3.0 wt % to about 10.0 wt %;

a sulfur content from about 900 wppm to about 1000 wppm;

a density at 15° C. of about 0.87 g/cm$^3$ to about 0.95 g/cm$^3$; and a kinematic viscosity at 50° C. of about 20 cSt to about 150 cSt.

5. The marine or bunker fuel composition of claim 4, having at least six of the enumerated properties.

6. The marine or bunker fuel composition of claim 4, having all of the enumerated properties.

7. An improved method for blending fuel oils, wherein a first fuel oil has a first sulfur content of at least 0.15 wt %, a first asphaltene content, a first BMCI (Bureau of Mines Correlation Index) value, and a first TE (Toluene Equivalency) value, and wherein a second fuel oil has a second sulfur content of less than about 0.1 wt %, a second asphaltene content, a second BMCI value, and a second TE value, the first asphaltene content being greater than the second asphaltene content, wherein either (i) a difference between the first BMCI value and the first TE value is about 40 or less and the first TE value is greater than about 0.75 times the second BMCI value, or (ii) the first asphaltene content is at least about 5.0 wt %, and the second asphaltene content is lower than the first asphaltene content by about 3.0 wt % or more, and wherein the first fuel oil is introduced into a fuel delivery system for an engine, and wherein the second fuel oil is introduced into the fuel delivery system for the engine, the first fuel oil and the second fuel oil being mixed within the fuel delivery system for the engine, the improvement comprising:

modifying the second fuel oil to increase the second asphaltene content by at least about 0.5 wt %, the modified second fuel oil having a modified asphaltene content of at least 2.5 wt or the modified second fuel oil having a modified asphaltene content of greater than or equal to 50% of the first asphaltene content, the modified second fuel oil being introduced into the fuel delivery system for the engine after said modifying.

8. The method of claim 7, wherein the improvement further comprises determining the second asphaltene content of the second fuel oil prior to modifying the second fuel oil.

9. The method of claim 7, wherein the modified second fuel oil has an asphaltene content of at least 2.5 wt %, a density at 15° C. of about 0.87 g/cm$^3$ to about 0.95 g/cm$^3$, and a kinematic viscosity at 50° C. of about 20 cSt to about 150 cSt.

10. The method of claim 7, wherein a difference between the second BMCI (Bureau of Mines Correlation Index) value and the second TE (Toluene Equivalency) is greater than or equal to a difference between the first BMCI value and the first TE value.

11. The method of claim 7, wherein a) the first sulfur content is 0.15 wt % to about 0.5 wt %, or b) the second sulfur content is about 1 wppm to about 1000 wppm, or a combination thereof.

12. The method of claim 7, wherein the first asphaltene content is greater than the second asphaltene content by at least about 3.0 wt %.

13. The method of claim 7, wherein modifying the second fuel oil comprises blending the second fuel oil with a composition comprising at least about 50 wt % of one or more asphaltene-containing fractions.

14. The method of claim 7, wherein modifying the second fuel oil comprises adding an additive comprising and alkaryl sulfonic acid to the second fuel oil.

15. A method for improving a compatibility of a second fuel oil with a first fuel oil, the first fuel oil having a sulfur content of at least 0.15 wt % and a difference between a first BMCI (Bureau of Mines Correlation Index) value and a first TE (Toluene Equivalency) value of 40 or less, the first TE value being greater than about 0.75 times a second BMCI value of the second fuel oil, the first fuel oil having a first asphaltene content greater than a second asphaltene content of the second fuel oil, and the second fuel oil having a sulfur content of less than about 0.1 wt %, a second asphaltene content, a density, a kinematic viscosity, a second BMCI value, and a second TE value, the method comprising:

modifying the second fuel oil to modify the second asphaltene content, density, and/or kinematic viscosity, the modified second fuel oil having an asphaltene content of at least about 2.5 wt %, a density at 15° C. of about 0.87 g/cm$^3$ to about 0.95 g/cm$^3$, and a kinematic viscosity at 50° C. of about 20 cSt to about 150 cSt.

16. The method of claim 15, wherein determining the second asphaltene content, density, and/or kinematic viscosity of the second fuel oil comprises determining a density at a temperature of about 0° C. to about 50° C., determining a kinematic viscosity at a temperature of about 0° C. to about 100° C., or a combination thereof.

17. The method of claim 15, further having, prior to modifying the second fuel oil, a toluene equivalency (TE) value for one or more blend ratios of the first fuel oil and the second fuel oil based on the relationship $$TE=\Sigma TE_i*A_i*y_i/\Sigma A_i*y_i$$

where $TE_i$ is the TE value of component i, $y_i$ is the percentage of component i in the blend at a blend ratio, and $A_i$ is the asphaltene content of component i.

18. The method of claim 15, further having, after modifying the second fuel oil, a toluene equivalency (TE) value for one or more blend ratios of the first fuel oil and the second fuel oil based on the relationship $$TE=\Sigma TE_i*A_i*y_i/\Sigma A_i*y_i$$

where $TE_i$ is the TE value of component i, $y_i$ is the percentage of component i in the blend at a blend ratio, and $A_i$ is the asphaltene content of component i.

19. The method of claim 18, wherein the difference between the BMCI (Bureau of Mines Correlation Index) and the TE (Toulene Equivalencey) of each of the one or more blend ratios is at least about 15.

20. The method of claim 15, wherein the second fuel oil has a second asphaltene content of about 0 wt % to about 2.0 wt %.

* * * * *